US009617680B2

(12) United States Patent
Kitayama et al.

(10) Patent No.: US 9,617,680 B2
(45) Date of Patent: Apr. 11, 2017

(54) CLOTHES DRYER AND CONTROL METHOD THEREOF

(71) Applicant: SAMSUNG ELECTRONICS CO., LTD., Suwon-si (KR)

(72) Inventors: Naoki Kitayama, Yokohama (JP); Eiji Wakizaka, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/882,537

(22) Filed: Oct. 14, 2015

(65) Prior Publication Data

US 2016/0138209 A1 May 19, 2016

(30) Foreign Application Priority Data

Nov. 19, 2014 (JP) ..... 2014-234346
Apr. 20, 2015 (KR) ..... 10-2015-0055135

(51) Int. Cl.
*D06F 58/24* (2006.01)
*D06F 58/26* (2006.01)
(Continued)

(52) U.S. Cl.
CPC ..... *D06F 58/24* (2013.01); *D06F 58/206* (2013.01); *D06F 58/26* (2013.01); *D06F 58/28* (2013.01);
(Continued)

(58) Field of Classification Search
CPC ..... F26B 19/00; F26B 21/00; F26B 21/06; D06F 58/24; D06F 58/26; D06F 58/28
(Continued)

(56) References Cited

U.S. PATENT DOCUMENTS 5,042,171 A * 8/1991 Obata ..... D06F 58/24 34/604
8,347,520 B2 * 1/2013 Kuwabara ..... D06F 58/206 34/134
(Continued)

FOREIGN PATENT DOCUMENTS

DE 19642164 A1 4/1998
DE 102012216397 A1 3/2014
(Continued)

OTHER PUBLICATIONS

Communication dated Mar. 31, 2016, issued by the European Patent Office in counterpart European Application No. 15186574.8.

*Primary Examiner* — Stephen M Gravini
(74) *Attorney, Agent, or Firm* — Sughrue Mion, PLLC

(57) ABSTRACT

Provided is a clothes dryer including: a drum; an air circulation passage connected to the drum; a cooling device configured to cool and dehumidify air; a heating device configured to heat the air; an air blowing device configured to circulate air; a base plate configured to collect condensation water generated from the cooling device; a pump chamber accommodating a pump; a water circulation passage connecting the base plate to communicate with the pump chamber; a communication passage provided between the air circulation passage and the base plate and configured to guide the condensation water generated at the cooling device to the base plate; a first ventilation hole configured to provide a first air passage between the air circulation passage and the pump chamber; and a second ventilation hole configured to provide a second air passage between the air circulation passage and the base plate.

20 Claims, 24 Drawing Sheets

(51) Int. Cl.
*D06F 58/28* (2006.01)
*D06F 58/20* (2006.01)

(52) U.S. Cl.
CPC ..... *D06F 2058/2832* (2013.01); *D06F 2058/2864* (2013.01); *D06F 2058/2896* (2013.01)

(58) Field of Classification Search
USPC ..... 34/499, 595; 68/19, 20; 8/149, 159
See application file for complete search history.

(56) References Cited

U.S. PATENT DOCUMENTS

| | | | | |
|---|---|---|---|---|
| 9,335,095 | B2 * | 5/2016 | Bison | D06F 39/12 |
| 2013/0312274 | A1 | 11/2013 | Pillot et al. | |
| 2014/0013616 | A1 | 1/2014 | Lee et al. | |
| 2014/0026433 | A1 | 1/2014 | Bison et al. | |
| 2015/0345072 | A1 * | 12/2015 | Ko | D06F 58/203 34/493 |
| 2016/0040349 | A1 * | 2/2016 | Ros | D06F 58/28 34/319 |
| 2016/0138209 | A1 * | 5/2016 | Kitayama | D06F 58/24 34/499 |
| 2016/0160419 | A1 * | 6/2016 | Ryoo | D06F 58/206 68/12.14 |
| 2016/0312395 | A1 * | 10/2016 | Driussi | H02M 5/293 |

FOREIGN PATENT DOCUMENTS

| | | | | |
|---|---|---|---|---|
| IT | WO 2012072482 | A3 * | 7/2012 | D06F 58/24 |
| JP | 200918089 | A | 1/2009 | |
| JP | 2014-104263 | A | 6/2014 | |
| KR | 10-2006-0135566 | A | 12/2006 | |
| KR | EP 2684996 | A2 * | 1/2014 | F26B 21/086 |

* cited by examiner

CLOTHES DRYER AND CONTROL METHOD THEREOF

CROSS-REFERENCE TO RELATED APPLICATION

This application claims priority from Korean Patent Application No. 10-2015-0055135, filed on Apr. 20, 2015 in the Korean Intellectual Property Office and JP2014-234346, filed on Nov. 19, 2014 in the Japan Patent Office, the disclosure of which are incorporated herein by reference in their entireties.

BACKGROUND

1. Field

Methods and apparatuses consistent with exemplary embodiments relate to a clothes dryer (or a laundry dryer) and a control method thereof.

2. Description of the Related Art

As one type of a clothes dryer, there is a circulation type clothes dryer in which air dehumidified and heated by a heat exchanger is circulated to dry clothes.

The circulation type clothes dryer includes a cooling device which cools and dehumidifies circulation air, a heating device which heats the air dehumidified by passing through the cooling device, an air blowing device which circulates the air, and an air circulation passage which guides the air to be circulated. All of the cooling device, the heating device and the air blowing device are disposed along the air circulation passage.

During the drying process, moisture contained in the circulation air may be condensed on a surface of the cooling device, and thus condensation liquid (e.g., water) is generated.

A condensation water container for collecting the condensation water is provided in the clothes dryer, and the condensation water collected in the condensation water container is discharged or stored in a separate storage tank.

For example, in Japanese Patent Laid-Open No. 2011-239817 (Patent Document 1), there is disclosed a technique in which the condensation water separated from the cooling device is collected in a base plate, and then the condensation water collected in the base plate is discharged to an outside of a laundry drying machine using a pump. Also, in a clothes dryer disclosed in Japanese Patent Laid-Open No. 2014-33849 (Patent Document 2), the condensation water condensed by a dehumidifying unit is collected in a dehumidifying tank through a collection passage which extends under the dehumidifying unit, and the water collected in the dehumidifying tank is supplied to a storage tank disposed above a main body of the clothes dryer by a pump.

SUMMARY

In a circulation type clothes dryer of the related art, the condensation water container is disposed at a lower side in a direction of gravity than the cooling device, and the condensation water falls by gravity or is collected through a water passage which connects the cooling device with the condensation water container.

However, when the air blowing device is installed at a downstream side of the heat exchanger, a pressure in the air circulation passage may be lower than a pressure in the condensation water container. In this case, the condensation water in the condensation water container or the water passage connecting the cooling device with the condensation water container may flow back into the air circulation passage. When the condensation water flows back into the air circulation passage, the condensation water may be dispersed to the clothes in a drum along with the air circulated by the air blowing device, and thus may disrupt a drying operation.

In Patent Document 2, a water level sensor is installed at the condensation water container (the dehumidifying tank in Patent Document 2). When it is detected by the water level sensor that the condensation water in the condensation water container reaches a predetermined water level, the pump is operated, and thus the condensation water is prevented from flowing back into the air circulation passage (the heater case in the Patent Document 2). However, the condensation water may not be collected properly in the condensation water container due to a negative pressure, and the water level may not be normally detected by the water level sensor, and thus the pump may not be normally operated.

Recently, a use of the blowing device generating a high air volume is required to enhance operation efficiency of the clothes dryer. When the air volume is increased using the air blowing device generating the high air volume, the pressure in the air circulation passage located at an upstream side of the air blowing device is further lowered, and thus the backflow problem of the condensation water may worsen. More specifically, the pressure in the air circulation passage (the circulation duct) is further lowered, compared with the air blowing device before the air volume is increased, and thus the air may be introduced through an outlet port of the pump. According to the introduction of the air, the air is introduced into a casing part of the pump in which an impeller is installed, and bubbles may be generated in the casing part. When the bubbles are generated in the casing part, the water may not be discharged by the pump. Also, when the circulation air of a discharge side of the air blowing device leaks due to a defect of a drum seal or the like, the pressure in the air circulation passage (the circulation duct) may be further lowered than that in a normal state. In this case, the same problem may occur. In the above-described state, the water level of a pump chamber is not lowered, even when the pump is operated. Therefore, the backflow and the dispersing of the condensation water may occur, if it is ignored.

Therefore, one or more exemplary embodiments provide a clothes dryer which is capable of preventing the backflow and the dispersing of the condensation water, even when the air volume generated by the air blowing device is increased.

In accordance with an aspect of an exemplary embodiment, there is provided a clothes dryer including a drum configured to accommodate clothes, an air circulation passage connected to the drum, a cooling device configured to cool and dehumidify air in the air circulation passage, a heating device configured to heat the air passing through the cooling device, an air blowing device configured to circulate air along the air circulation passage, a base plate configured to receive and collect condensation water generated from the cooling device, a pump chamber configured to receive a pump which transfers the condensation water, a water circulation passage configured to enable the base plate to communicate with the pump chamber, to guide the condensation water in the base plate to the pump chamber, and to ventilate the base plate and the pump chamber, a communication passage configured to enable the air circulation passage to communicate with the base plate and to guide the condensation water generated at the cooling device to the base plate, a first ventilation hole provided between the heating device and the air blowing device to enable the air circulation passage to communicate with the pump chamber, and a second ventilation hole provided between the cooling device and the heating device to communicate the air circulation passage with the base plate.

The clothes dryer may further include a support plate configured to partition between the air circulation passage and the base plate and to support the cooling device and the heating device, and the first ventilation hole and the second ventilation hole may be provided at the support plate.

The support plate may include a concave portion provided between the cooling device and the heating device, and recessed downward, and the second ventilation hole may be provided at the concave portion so that ventilation between the air circulation passage and the base plate is performed from a lower portion of the concave portion to the heating device.

The concave portion may be formed by a V-shaped groove which extends horizontally in a direction perpendicular to a flowing direction of drying air in the air circulation passage, and an opening cut away so that a width thereof is gradually narrower toward a center side in a lengthwise direction of the V-shaped groove may be provided at both ends in the lengthwise direction of the V-shaped groove.

The clothes dryer may further include a water level detecting part configured to detect a water level in the pump chamber, and a control unit configured to control the air blowing device, and the control unit may control the number of rotations of the air blowing device to be reduced, when a preset time elapses after an operation of the pump is started and the water level detected by the water level detecting part is equal to or higher than a preset threshold value.

The clothes dryer may further include a water storage part configured to receive the condensation water transferred by the pump, and the pump may be connected to the water storage part through a connection waterway, and a check valve which prevents air from being introduced from the water storage part toward the pump may be installed at the connection waterway.

The clothes dryer may further include a water storage part configured to receive the condensation water transferred by the pump, and the pump may include a pump casing having a suction port through which the condensation water is suctioned and an discharge port through which the condensation water is discharged to the water storage part, a motor disposed in the pump casing and having an output shaft which extends in a direction perpendicular to a surface of the suction port, and an impeller which rotates along with the output shaft, and the suction port and the impeller of the pump casing may be inclined with respect to a horizontal surface so that the discharge port is located higher.

A third ventilation hole which enables the air circulation passage to communicate with another space other than the air circulation passage, the base plate and the pump chamber may be provided between the heating device and the air blowing device.

The clothes dryer may further include an opening and closing valve configured to open and close the third ventilation hole according to a preset condition.

The pump chamber may be connected with an atmospheric air side through a check valve, and the check valve may be opened so that atmospheric air is introduced into the pump chamber, when a pressure in the pump chamber is lower than an atmospheric pressure by a predetermined value or more.

The clothes dryer may further include a water level detecting part configured to detect a water level in the pump chamber, and a control unit configured to control the air blowing device and the pump, and the control unit may control a fan of the air blowing device to be alternatively rotated at a normal number of rotations and a low speed number of rotations which is lower than the normal number of rotations according to a preset time period, and may control the pump to be operated, when the water level detected by the water level detecting part is equal to or higher than a preset threshold value while the fan is rotated at the low speed number of rotations.

The clothes dryer may further include a water level detecting part configured to detect a water level in the base plate, and a control unit configured to control the air blowing device, and the control unit may control the number of rotations of the air blowing device to be reduced, when a preset time elapses after an operation of the pump is started and the water level detected by the water level detecting part is equal to or higher than a preset threshold value.

The clothes dryer may further include a water level detecting part configured to detect a water level in the base plate, and a control unit configured to control the air blowing device and the pump, and the control unit may control a fan of the air blowing device to be alternatively rotated at a normal number of rotations and a low speed number of rotations which is lower than the normal number of rotations according to a preset time period, and may control the pump to be operated, when the water level detected by the water level detecting part is equal to or higher than a preset threshold value while the fan is rotated at the low speed number of rotations.

A lower surface of the pump chamber may be located at a position lower than a lower end of the water circulation passage, and the preset threshold value of the detected water level may be set to be lower than the lower end of the water circulation passage.

An internal upper surface of the water circulation passage may be located at a position higher than the communication passage and a lower end of the V-shape groove.

In accordance with an aspect of another exemplary embodiment, there is provided a method of controlling a clothes dryer including rotating a fan of an air blowing device at a normal number of rotations and confirming whether a water level equal to or higher than a preset threshold value is detected by a water level detecting part, operating a pump when the detected water level is equal to or higher than the preset threshold value, confirming whether a preset time elapses after the pump is operated, detecting the water level through the water level detecting part when the preset time elapses, and confirming whether the detected water level is equal to or higher than the preset threshold value, and rotating the fan at a low speed number of rotations which is lower than the normal number of rotations, when the detected water level is equal to or higher than the preset threshold value.

When the detected water level is less than the preset threshold value after the preset time passes, a number of rotations of the fan may be returned to the normal number of rotations, and the pump may be stopped.

In accordance with an aspect of yet another exemplary embodiment, there is provided a method of controlling a clothes dryer includes rotating a fan of an air blowing device at a normal number of rotations, confirming whether a preset time elapses, rotating the fan at a low speed number of rotations which is lower than the normal number of rotations, when the preset time elapses, confirming whether a water level equal to or higher than a preset threshold value is detected by a water level detecting part, and when the water level equal to or higher than the preset threshold value is detected by the water level detecting part, maintaining a number of rotations of the fan at the low speed number of rotations, or rotating the fan at a lower speed number of rotations which is lower than the low speed number of rotations, and operating a pump.

While the number of rotations of the fan is maintained at the low speed number of rotations, or the fan is rotated at the lower speed number of rotations which is lower than the low speed number of rotations, whether the water level equal to or higher than the preset threshold value is detected by the water level detecting part may be repeatedly confirmed.

When the detected water level is less than the preset threshold value, the number of rotations of the fan may be returned to the normal number of rotations, and the pump may be stopped.

In accordance with an aspect of yet another exemplary embodiment, there is provided a clothes dryer including: a drum configured to accommodate clothes; an air circulation passage connected to the drum; a cooling device configured to cool and dehumidify air in the air circulation passage; a heating device configured to heat the air passing through the cooling device; an air blowing device configured to circulate air along the air circulation passage; a base plate configured to collect condensation water generated from the cooling device; a pump chamber configured to accommodate a pump configured to transfer the condensation water; a water circulation passage connecting the base plate to communicate with the pump chamber and configured to guide the condensation water from the base plate to the pump chamber; a communication passage provided between the air circulation passage and the base plate and configured to guide the condensation water generated at the cooling device to the base plate; a first ventilation hole provided between the heating device and the air blowing device and configured to provide a first air passage between the air circulation passage and the pump chamber; and a second ventilation hole provided between the cooling device and the heating device and configured to provide a second air passage between the air circulation passage and the base plate.

The clothes dryer may further include a support plate configured to partition the air circulation passage and the base plate from each other and to support the cooling device and the heating device, wherein the first ventilation hole and the second ventilation hole may be provided at the support plate.

The support plate may include a concave portion provided between the cooling device and the heating device and recessed downward, and wherein the second ventilation hole may be provided at the concave portion so that ventilation between the air circulation passage and the base plate is performed.

The concave portion may be formed by a V-shaped groove which extends in a widthwise direction of the clothes dryer and in an intersecting direction to a flowing direction of the air passing through the cooling device in the air circulation passage, and wherein the V-shaped groove may include a cut-away portion having a width thereof gradually narrowing toward a center side in a lengthwise direction perpendicular to the widthwise direction of the V-shaped groove is provided at opposite ends of the V-shaped groove along the widthwise direction of the clothes dryer.

The clothes dryer may further include a water level detecting part configured to detect a water level in the pump chamber, and a controller configured to control the air blowing device, wherein the controller may be configured to control the air blowing device to reduce a number of rotations in a given time, in response to a preset time elapsing after an operation of the pump is started and the water level detected by the water level detecting part being greater than or equal to a preset threshold value.

The clothes dryer may further include a water storage part configured to receive the condensation water transferred by the pump, wherein the pump is connected to the water storage part through a connection waterway, and a check valve configured to prevent air from being introduced from the water storage part toward the pump is installed at the connection waterway.

The clothes dryer may further include a water storage part configured to receive the condensation water transferred by the pump, wherein the pump may include: a pump casing having: a suction port configured to intake the condensation water; and an discharge port configured to discharge the condensation water to the water storage part, a motor disposed in the pump casing and including: an output shaft extending in a direction perpendicular to a surface of the suction port, and an impeller configured to rotate along with the output shaft, and wherein the suction port and the impeller of the pump casing are inclined with respect to a horizontal surface so that the discharge port is located higher.

A third ventilation hole may be provided between the heating device and the air blowing device and is configured to provide a third air passage between the air circulation passage and a space excluding the air circulation passage, the base plate and the pump chamber.

The clothes dryer may further include an opening and closing valve configured to open or close the third ventilation hole according to a preset condition.

The pump chamber may be connected with an atmospheric air through a check valve, and wherein in response to a pressure in the pump chamber being lower than an atmospheric pressure by a predetermined value or more, the check valve may be configured to be opened so that atmospheric air is introduced into the pump chamber.

The clothes dryer may further include a water level detecting part configured to detect a water level in the pump chamber, and a controller configured to control the air blowing device and the pump, wherein the controller may be configured to control a fan of the air blowing device to be alternatively rotated at a first number of rotations in a given time and a second number of rotations in the given time which is lower than the first number of rotations according to a preset time period, and to control the pump to operate, in response to the water level detected by the water level detecting part being greater than or equal to a preset threshold value while the fan is rotated at the second number of rotations in the given time.

The clothes dryer may further include a water level detecting part configured to detect a water level in the base plate, and a controller configured to control the air blowing device, wherein the controller is configured to control the number of rotations of the air blowing device in a given time to be reduced in response to a preset time elapsing after an operation of the pump is started and the water level detected by the water level detecting part being greater than or equal to a preset threshold value.

The clothes dryer may further include a water level detecting part configured to detect a water level in the base plate, and a controller configured to control the air blowing device and the pump, wherein the controller is configured to control a fan of the air blowing device to be alternatively rotated at a first number of rotations in a given time and a second number of rotations in the given time which is lower than the first number of rotations according to a preset time period, and to control the pump to operate, in response to the water level detected by the water level detecting part being great than or equal to a preset threshold value while the fan is rotated at the second number of rotations in the given time.

In accordance with an aspect of yet another exemplary embodiment, there is provided a method of controlling a clothes dryer, including: rotating a fan of an air blowing device at a first number of rotations in a given time and comparing a water level detected by a water level detecting part and a preset threshold value; operating a pump in response to the detected water level being greater than or equal to the preset threshold value; determining whether a preset time elapses after the pump is operated; detecting the water level by the water level detecting part in response to the preset time elapsing, and comparing the detected water level and the preset threshold value; and rotating the fan at a second number of rotations in the given time which is lower than the first number of rotations in the given time in response to the detected water level being greater than or equal to the preset threshold value.

In response to the detected water level being less than the preset threshold value after the preset time elapsing, controlling the fan to return to the first number of rotations in the given time, and stopping the pump.

In accordance with an aspect of yet another exemplary embodiment, there is provided a method of controlling a clothes dryer, including: rotating a fan of an air blowing device at a first number of rotations in a given time; determining whether a preset time elapses; rotating the fan at a second number of rotations in the given time which is lower than the first number of rotations in the given time, in response to the preset time elapsing; comparing a water level detected by a water level detecting part and a preset threshold value; and in response to the water level being greater than or equal to the preset threshold value, maintaining the fan to rotate at the second number of rotations in the given time, or controlling the fan to rotate at a third number of rotations in the given time which is lower than the second number of rotations in the given time, and controlling a pump to operate.

The method may further include repeatedly determining whether the water level is greater than or equal to the preset threshold value while the fan is controlled to rotate at the second number of rotations, or is controlled to rotate at the third number of rotations.

In response to the detected water level being less than the preset threshold value, controlling the fan to returned to rotating at the first number of rotations in the given time, and stopping the pump.

BRIEF DESCRIPTION OF THE DRAWINGS

The above and/or other aspects of the disclosure will become apparent and more readily appreciated from the following description of exemplary embodiments, taken in conjunction with the accompanying drawings of which.

DETAILED DESCRIPTION

Hereinafter, exemplary embodiments will be described with reference to the accompanying drawings. The exemplary embodiments described below are intended to merely illustrate examples, and are not intended to limit the scope of the inventive concept.

—Structure of Clothes Dryer—

Figure 1:
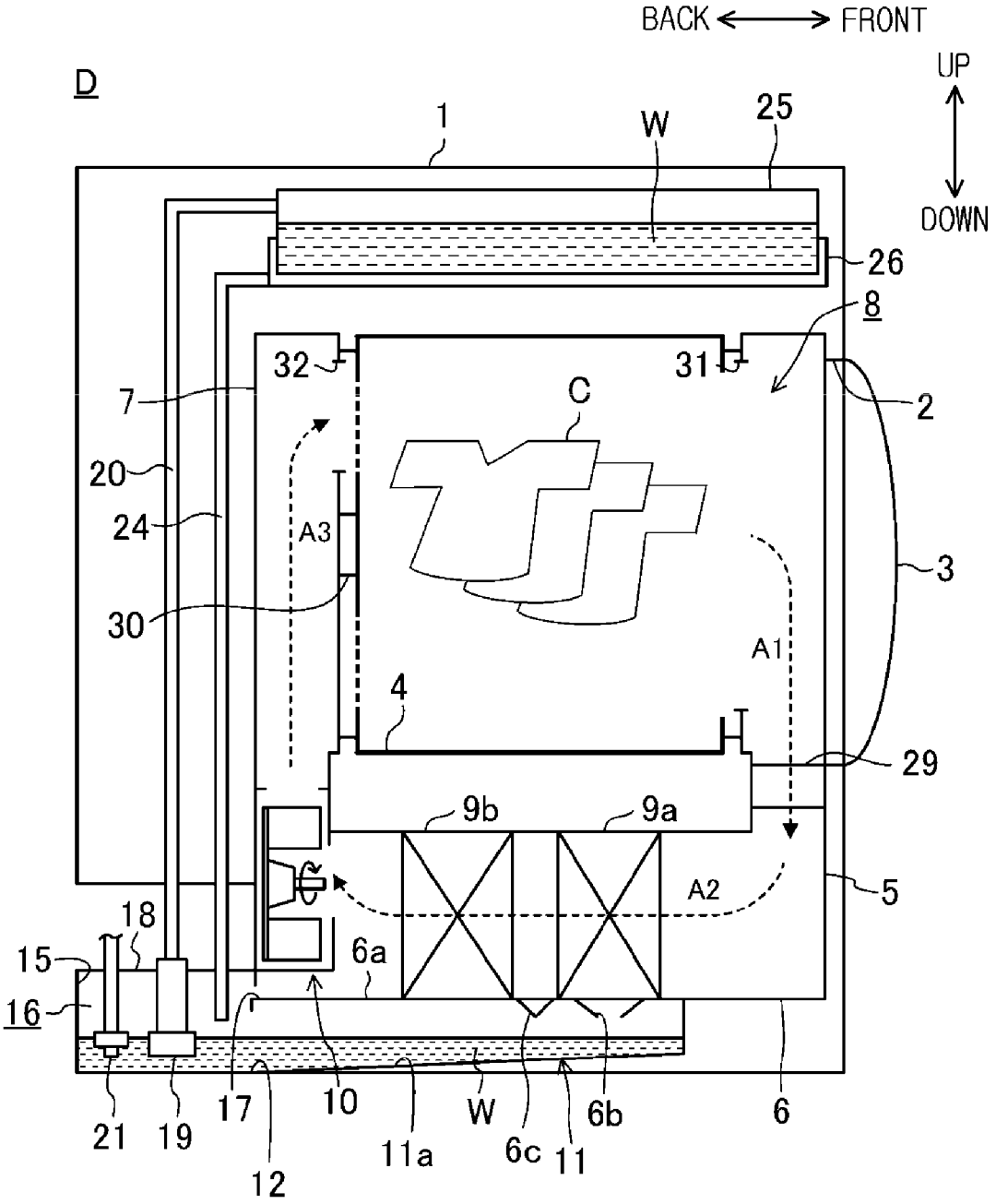
FIG. 1 is a schematic view illustrating a structure of a clothes dryer according to an exemplary embodiment.

As illustrated in FIG. 1, a clothes dryer D includes a longitudinally long rectangular parallelepiped-shaped main body 1 which has the largest dimension in a vertical direction (i.e., the gravitational direction).

A clothes entrance 2 which is open in the form of an approximate circle when seen from a front side is provided in a front surface of the main body 1. The clothes entrance 2 is opened and closed by a door 3 rotatably installed at the main body 1. A drum 4 in which clothes C to be dried are placed is rotatably installed in the main body 1. An inside of the drum 4 is in communication with the clothes entrance 2. When the clothes entrance 2 is opened through the door 3, the clothes C may be placed into the drum 4 through the clothes entrance 2, or the dried clothes C may be removed through the clothes entrance 2.

The drum 4 is formed in a cylindrical shape of which a rotation axis extends horizontally in a front-rear direction at a center of a base of the drum. An opening through which the clothes C may be introduced is provided at a front surface of the drum 4, and a rear surface of the drum 4 is closed. The opening of the drum 4 is disposed toward the clothes entrance 2, and a shaft 30 serving as an output shaft is connected to the rear surface of the drum 4, and thus the drum 4 is rotatably installed at a side wall of a return side duct 7 to be described below. Therefore, the drum 4 receives a rotating force through the shaft 30 and rotates around the rotation axis.

Also, a circulation air exhaust port 31 through which the air used in drying the clothes C is discharged, and a circulation air intake port 32 through which the air to be used in drying the clothes C is suctioned are connected to the drum 4.

The shaft 30 is connected to a drum rotating motor (not shown) disposed in the main body 1. Therefore, when the clothes dryer D is operated, the shaft 30 is rotated by the drum rotating motor, and thus the drum 4 is rotated at a predetermined speed. Also, the rotating force generated from the drum rotating motor may be transmitted to the drum 4 through a belt (not shown), and thus the drum 4 may be rotated.

An exhaust side duct 5 of which one end is connected with the circulation air exhaust port 31, the return side duct 7 of which one end is connected with the circulation air intake port 32, a drying duct 6 which connects the other end of the exhaust side duct 5 with the other end of the return side duct 7, and an air circulation passage 8 which is provided in the exhaust side duct 5, the drying duct 6 and the return side duct 7 to circulate the air in the drum 4 are provided in the main body 1. Further, a lint filter 29 disposed at an upstream side of an condenser 9*a* and an evaporator 9*b*, which will be described below, to collect lint generated from the clothes is installed at the air circulation passage 8. Therefore, the lint generated from the clothes C is collected by the lint filter 29, and the collected lint may be removed to an outside.

More specifically, the exhaust side duct 5 is formed at a front portion of the main body 1 to extend vertically, and an upper end thereof is hermetically connected with the circulation air exhaust port 31. The drying duct 6 is formed at a lower portion of the main body 1 (i.e., a lower side of the drum 4) to extend in a front-rear direction, and a front end thereof is hermetically connected with a lower end of the exhaust side duct 5. The return side duct 7 is formed at a rear side of the main body 1 to extend vertically, and a lower end thereof is hermetically connected with a rear end of the drying duct 6, and an upper end thereof is hermetically connected with the circulation air intake port 32. Also, the drum 4 is rotatably connected with the circulation air exhaust port 31 and the circulation air intake port 32.

Figure 2:
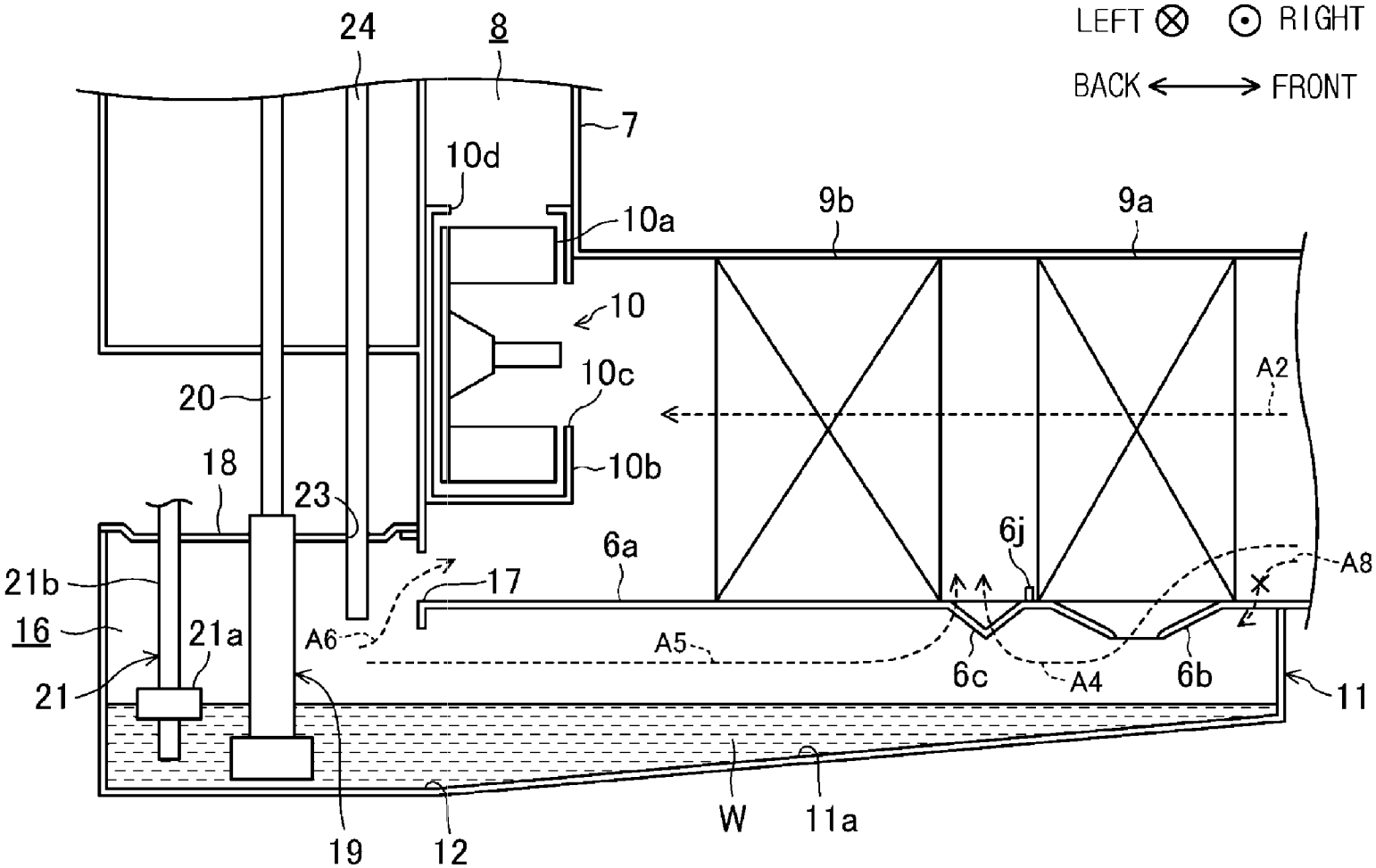
FIG. 2 is an enlarged view illustrating a schematic structure of a lower portion of the clothes dryer according to an exemplary embodiment.

An air blowing device 10 is installed at a connection part between the drying duct 6 and the return side duct 7, i.e., a portion in which the drying duct 6 extending in a front-rear direction under the drum 4 is bent upward. The air blowing device 10 serves to suction and discharge the air so that the air is circulated through the air circulation passage 8 and the drum 4, and includes a casing 10*b*, and a fan 10*a* which is rotatably installed in the casing 10*b* and has a plurality of wings, as illustrated in FIG. 2. An air intake port 10*c* which is open in a direction parallel to a rotating shaft of the fan 10*a*, and an air exhaust port 10*d* which is open in a direction perpendicular to the rotating shaft of the fan 10*a* are provided in the casing 10*b*. The air intake port 10*c* is connected with the rear end of the drying duct 6, and the air exhaust port 10*d* is connected with the lower end of the return side duct 7. Also the air blowing device 10 may be a centrifugal type air blowing device such as a sirocco fan.

Figure 4:
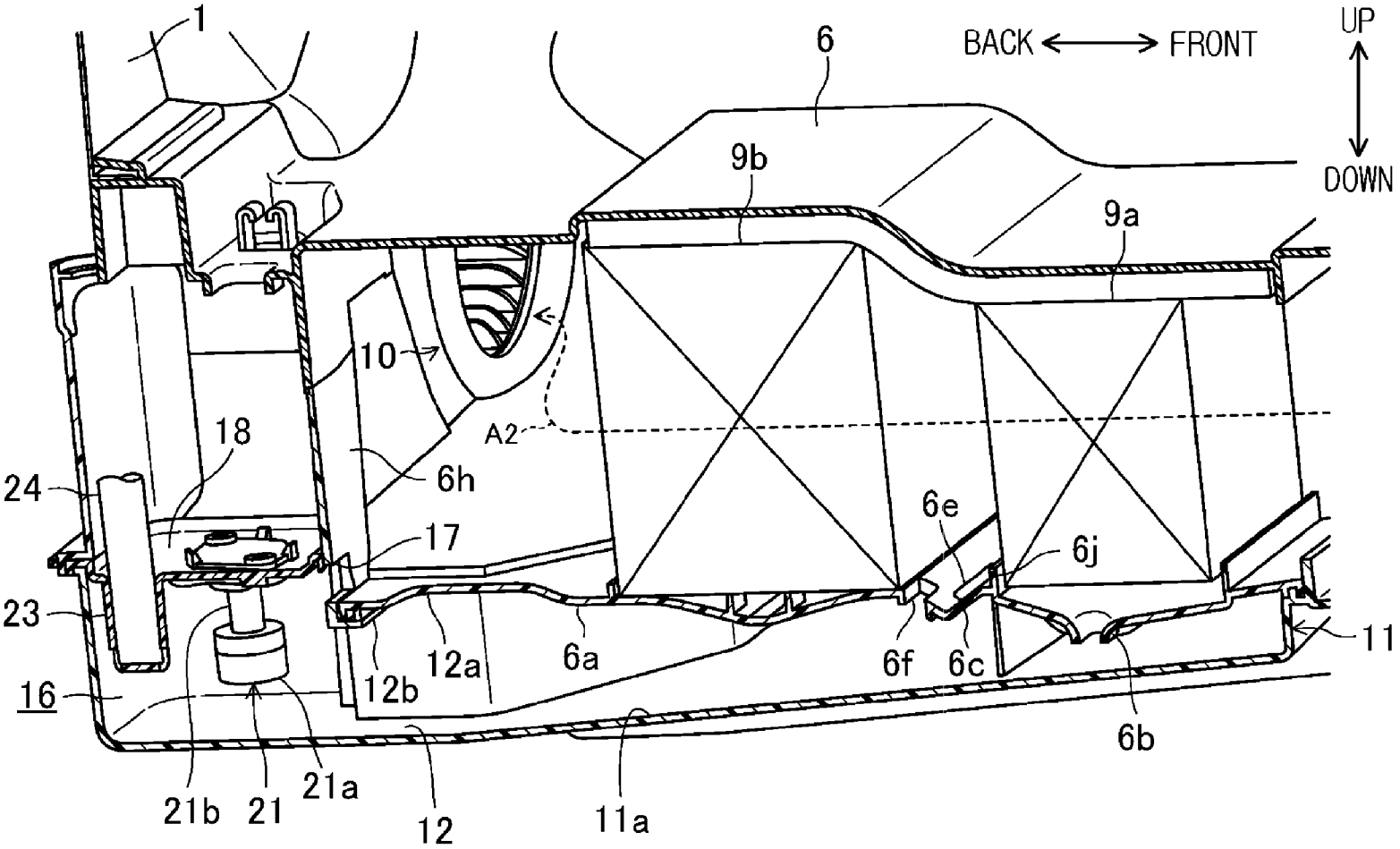
FIG. 4 is an enlarged perspective view illustrating a partly omitted structure of the lower portion of the clothes dryer according to an exemplary embodiment.

As illustrated in FIGS. 1, 2 and 4, the condenser 9*a* configured with a heat exchanger and used as a cooling device which cools and dehumidifies the air, and the evaporator 9*b* configured with a heat exchanger and used as a heating device which heats the air passed through the condenser 9*a* are disposed in the air circulation passage 8. The condenser 9*a* and the evaporator 9*b* are disposed on a cover base 6*a* which serves as a support plate in the drying duct 6, and supported by the cover base 6*a*. The condenser 9*a* is disposed at an upstream side (a front side) of the air circulation passage 8, and the evaporator 9*b* is disposed at a downstream side (a rear side) of the condenser 9*a* to be spaced apart from the condenser 9*a*. Also, although not shown in the drawings, the clothes dryer D includes a compressor configured to compress a refrigerant, and a pressure reducing device configured to depressurize and expand the refrigerant in the main body 1, and the condenser 9*a* and the evaporator 9*b* are connected with the compressor and the pressure reducing device through a refrigerant pipe, and form a heat pump cycle.

A base plate 11 which collects and stores condensation water W generated from the condenser 9*a* is installed under the drying duct 6. The base plate 11 is open upward, and an upper side of the open base plate 11 is closed by the cover base 6*a*. Also, the cover base 6*a* is a partition between the drying duct 6 and the base plate 11.

A drain hole 6*b* which is provided under the condenser 9*a* to pass through the cover base 6*a* in a vertical direction and used as a communication passage is provided in the cover base 6*a*. Therefore, when the air passing through the air circulation passage 8 is dehumidified, the condensation water W generated from the condenser 9*a* is discharged to the base plate 11 through the drain hole 6*b*. In the exemplary embodiment, a portion of the cover base 6*a* located under the condenser 9*a* is formed to be inclined downward toward the drain hole 6*b*, and thus the condensation water W falling around the drain hole 6*b* may be guided to the drain hole 6*b* (referring to FIGS. 2 and 4).

Figure 3:
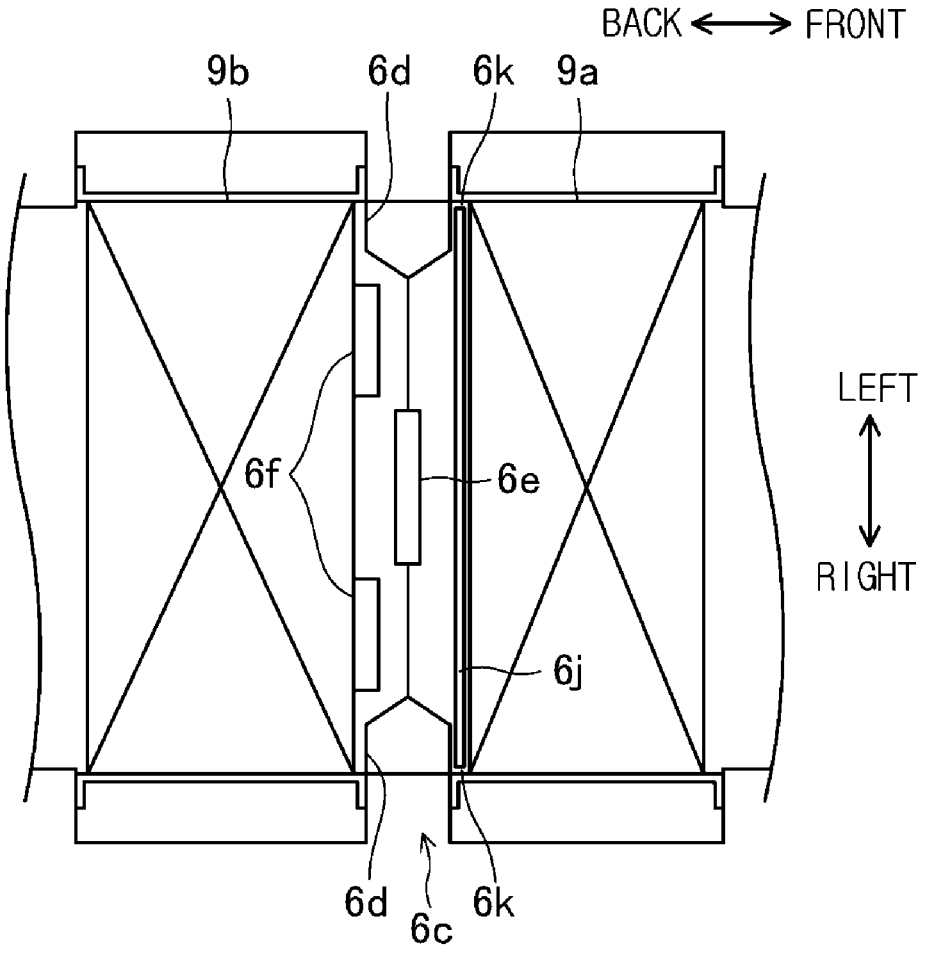
FIG. 3 is an enlarged plan view illustrating the vicinity of a ventilation hole of a cover base according to an exemplary embodiment.

Also, as illustrated in FIG. 3, a V-shaped groove 6*c* is provided in the cover base 6*a* between the condenser 9*a* and the evaporator 9*b*. As a portion of the cover base 6*a* between the condenser 9*a* and the evaporator 9*b* extends downward, the V-shaped groove 6*c* is formed to be inclined downward, and integrally formed in a V-shaped concave portion, when seen in a lateral direction (i.e., a left-to-right or a right-to-left direction). The V-shaped groove 6*c* extends in the lateral direction, and cut-away portions 6*d* and 6*d* cut toward a center side and serving as second ventilation holes are formed at both lateral (left and right) ends of the V-shaped groove 6*c*. Each cut-away portion 6*d* extends toward a center side along the lateral direction of the V-shaped groove 6*c*, and then is cut and opened so that a widthwise distance (extending from a front-to-back direction or a back-to-front direction) thereof is gradually narrower. Therefore, according to a plan view of the cut-away portion 6*d*, the cut-away portion 6*d* is cut to have a pentagonal shape which protrudes toward the center side along the lateral direction of the V-shaped groove 6*c*.

Also, a drain hole 6*e* formed in a rectangular shape which extends in the lateral direction and provided at a center side in the lateral direction and the widthwise direction (the front-to-back direction or the back-to-front direction) is provided at a lower portion (the cover base 6*a*) of the V-shaped groove 6*c* so that the condensation water passes vertically toward the base plate 11. Therefore, even when some of the condensation water W generated from the condenser 9*a* overflows through gaps 6*k* formed at both lateral directional ends of a rib 6*j* installed at a rear side of the condenser 9*a*, and flows into the V-shaped groove 6*c*, the condensation water W is discharged to the base plate 11 through the cut-away portions 6*d* and 6*d* and the drain hole 6*e*. That is, the cut-away portions 6*d* and 6*d* and the drain hole 6*e* also serve as communication passages for guiding the condensation water W generated from the condenser 9*a* to the base plate 11. Also, ventilation holes 6*f* and 6*f* formed in rectangular shapes which extend in the lateral direction and serve as first ventilation holes are formed at both of left and right sides of a rear end (a portion around the evaporator 9*b*) of the V-shaped groove 6*c*. Here, shapes of the drain hole 6*e* and the ventilation hole 6*f* are not limited to the rectangular shapes which extend in the lateral direction, and may be formed in elliptical holes which extend in the lateral direction, or may be configured so that a plurality of circular or elliptical holes are disposed in the lateral direction.

The condensation water W is collected in the base plate 11 through the drain holes 6*b* and 6*e* and the cut-away portions 6*d* and 6*d*. Here, as illustrated in FIGS. 1 and 4, a lower surface 11*a* of the base plate 11 is formed to extend toward a rear side and to be inclined downward, and thus the condensation water W collected in the base plate 11 is moved to the rear side. Also, the base plate 11 is formed to extend to the rear side, such that a lateral directional width thereof is gradually narrower, and the condensation water W is moved to and collected in the rear side by the base plate 11.

A communication waterway 12 used as a water circulation passage is integrally connected between the rear end of the base plate 11 and a front end of a pump chamber 16 which will be described below. Therefore, the condensation water W collected in the base plate 11 is transferred to the pump chamber 16 through the communication waterway 12. Here, as illustrated in FIG. 4, an internal upper surface 12*a* (a lower end of a connection portion 12*b* between the cover base 6*a* and a lower end of a rear side wall 6*h* of the drying duct 6) of the communication waterway 12 is located at a position higher than a lower end of the drain hole 6*b* and a lower end of the V-shaped groove 6*c*. Therefore, even when the condensation water W of the base plate 11 is collected in the pump chamber 16 through the communication waterway 12, the air may pass between the base plate 11 and the pump chamber 16 through the communication waterway 12. That is, a pressure difference does not occur between the base plate 11 and the pump chamber 16.

The pump chamber 16 is integrally connected with a rear end of the communication waterway 12 to accommodate the condensation water W transferred through the communication waterway W. The pump chamber 16 is open upward, and a cover 18 which hermetically closes an opening 15 of the pump chamber 16 is removably installed at the opening 15 of the pump chamber 16. The cover 18 has an interlocking shape which is interlocked with a rim of the opening 15 of the pump chamber 16. Therefore, the cover 18 may be interlocked and installed at the opening 15. Also, a sealing member (not shown) formed a soft material having flexibility, such as a rubber material and a soft resin, is installed at an outer edge of the cover 18, and thus the cover 18 may hermetically close the opening 15 through the sealing member.

Figure 6:
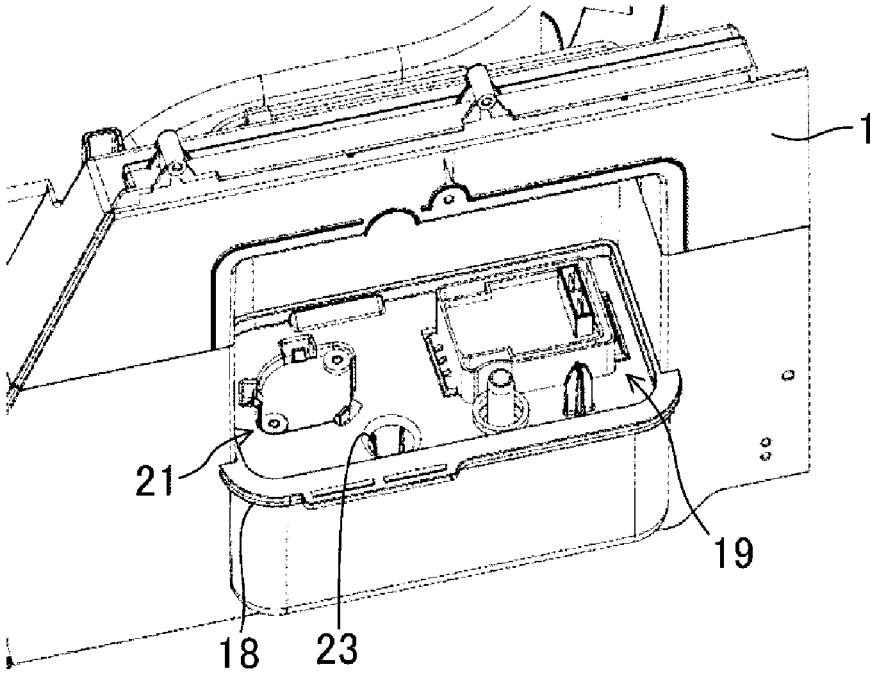
FIG. 6 is a partly omitted and enlarged perspective view illustrating a state in which a cover is installed at the pump chamber according to an exemplary embodiment.

As illustrated in FIG. 6, a pump 19 which pumps the condensation water transferred to the pump chamber 16 is installed at a right side of the cover 18, and a water level sensor 21 which serves as a water level detecting part for detecting a water level in the pump chamber 16 is installed at a left side of the cover 18. Also, a hose connection port 23 is provided at a lateral directional center portion of a rear side of the cover 18, and a leakage preventing hose 24 for preventing leakage of a water storage tank 25 which will be described is hermetically inserted into the hose connection port 23 (referring to FIG. 2). At this time, if necessary, the pump 19, the water level sensor 21 and the leakage preventing hose 24 may be separately removed from the cover 18.

Figure 7:
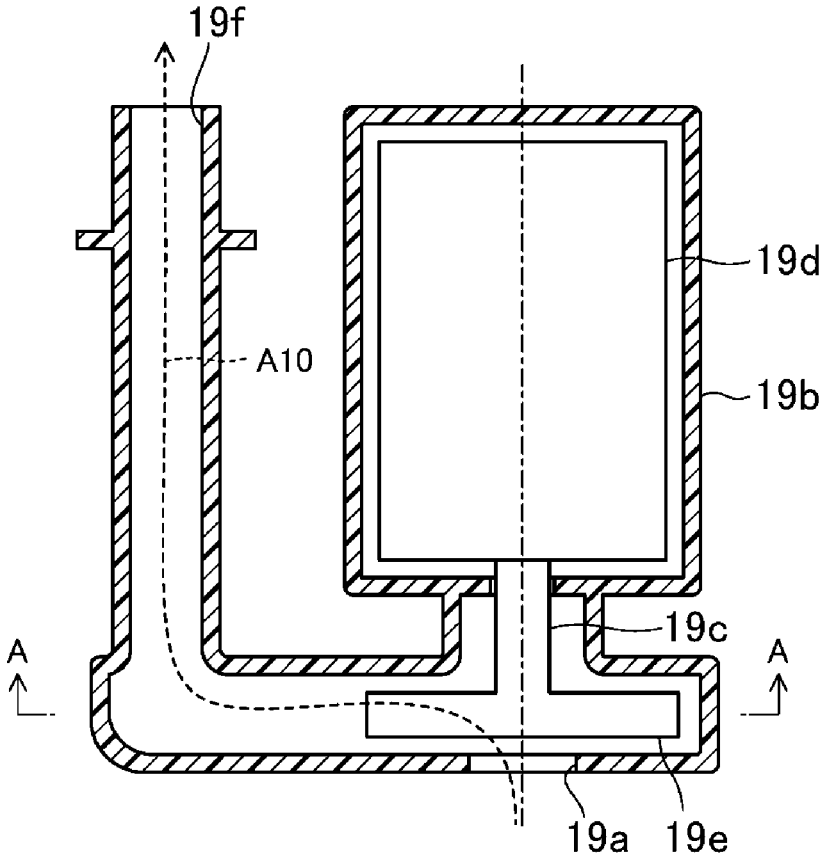
FIG. 7 is a side cross-sectional view illustrating a schematic structure of a pump according to an exemplary embodiment.
Figure 8:
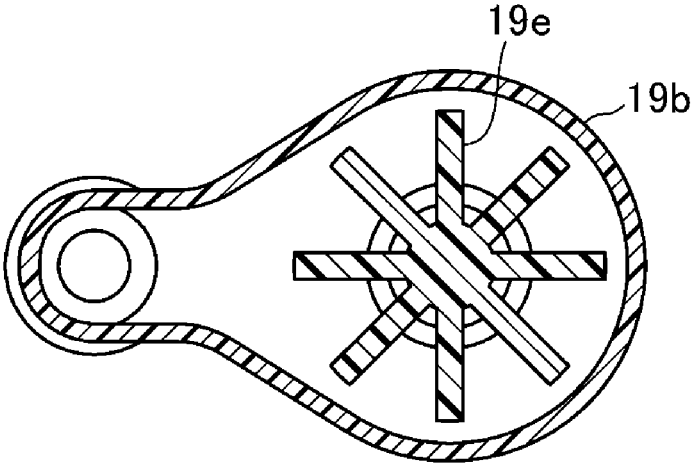
FIG. 8 is a cross-sectional view taken along a line A-A of FIG. 7.

As illustrated in FIGS. 7 and 8, the pump 19 is a lift type submersible pump. The pump 19 includes a pump casing 19*b* having an suction port 19*a* and an discharge port 19*f*, a shaft 19*c* which extends vertically in the pump casing 19*b* and serves as an output shaft, a motor 19*d* which rotates the shaft 19*c*, and an impeller 19*e* which is installed at an air intake port side end of the shaft 19*c* to be rotated with the shaft 19*c*. And the pump 19 is fixed to the cover 18 so that the suction port 19*a* is located at an internal lower side of the pump chamber 16, and the discharge port 19*f* is located above the cover 18. As the pump 19 is operated, the condensation water W in the pump chamber 16 is pumped upward and transferred to the water storage tank 25 which will be described below (referring to an arrow A10 in FIG. 7).

Also, one end of a lift hose 20 (formed of, for example, a synthetic resin material) which serves as a connection waterway is connected to the discharge port 19*f* of the pump 19. As illustrated in FIG. 1, the other end of the lift hose 20 is connected to the water storage tank 25 which is a water storing part for storing water. Therefore, the condensation water W which is pumped up from the pump chamber 16 by the pump 19 is transferred to the water storage tank 25. The water storage tank 25 is disposed in the main body 1 at a higher position than the drum 4, and if necessary, may be removed from the main body 1 to an outside. Also, the other end of the lift hose 20 may be connected to another place other than the water storage tank 25. For example, the lift hose 20 may be directly connected to a drain in a home or the like, and thus the condensation water may be directly discharged to a sewer.

The water storage tank 25 may be installed in a water tank base plate 26, and the condensation water W which overflows from the water storage tank 25 is received in the water tank base plate 26. The leakage preventing hose 24 is connected with a lower portion of the water tank base plate 26, and the condensation water W which overflows from the water storage tank 25 is returned to the pump chamber 16 through the leakage preventing hose 24. An inside of the pump chamber 16 is connected with the atmosphere through the water tank base plate 26 and the leakage preventing hose 24.

For convenience of description, FIG. 1 illustrates that the lift hose 20 and the leakage preventing hose 24 are located at a rear side of the return side duct 7. However, the exemplary embodiment is not limited thereto. For example, the lift hose 20 and the leakage preventing hose 24 may be located at a left or right side of the return side duct 7.

The water level sensor 21 is installed at the cover 18. The water level sensor 21 includes a pipe-shaped stem 21*b* which is fixed so as to extend downward from the cover 18, and a float 21*a* which is installed at the stem 21*b* to be movable vertically within a predetermined range, and the water level is detected according to a height of the float 21*a*. In the exemplary embodiment, the water level sensor 21 is the above-described float type sensor, but is not limited thereto.

Various other types of water level sensors such as an electrode type sensor may be used as the water level sensor.

Figure 5:
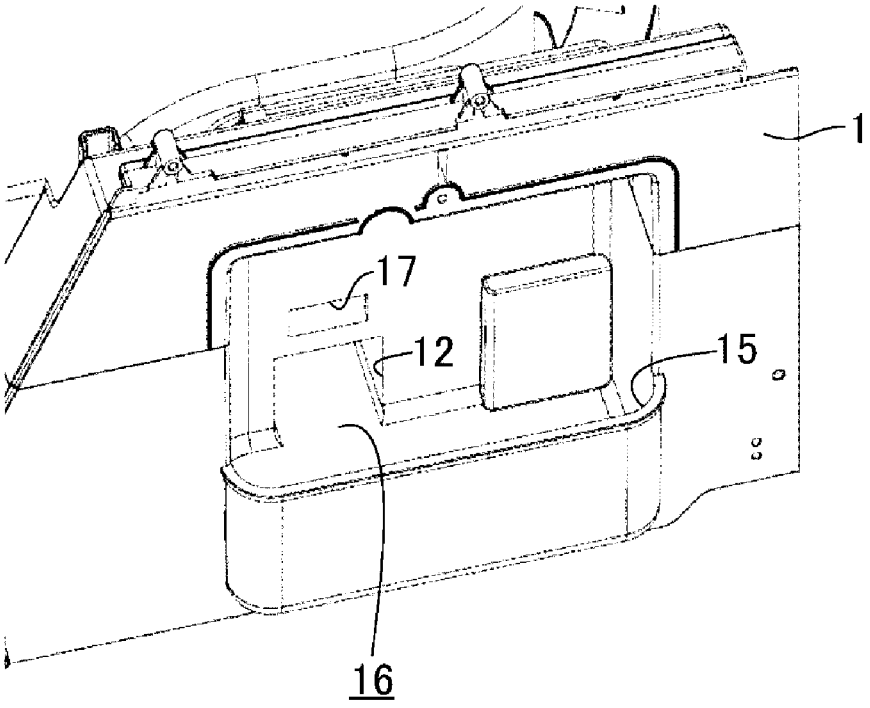
FIG. 5 is an enlarged perspective view illustrating a partly omitted structure of a pump chamber according to an exemplary embodiment.

As illustrated in FIGS. 4 and 5, a first ventilation port 17 is provided at a lower end of the rear side wall 6*h* of the drying duct 6 connected with a rear end of the cover base 6*a* to extend long in the lateral direction, and the inside of the pump chamber 16 is in communication with an inside of the air circulation passage 8 disposed at a downstream side (between the evaporator 9*b* and the air blowing device 10) of the air blowing device 10 through the first ventilation port 17.

Figure 9:
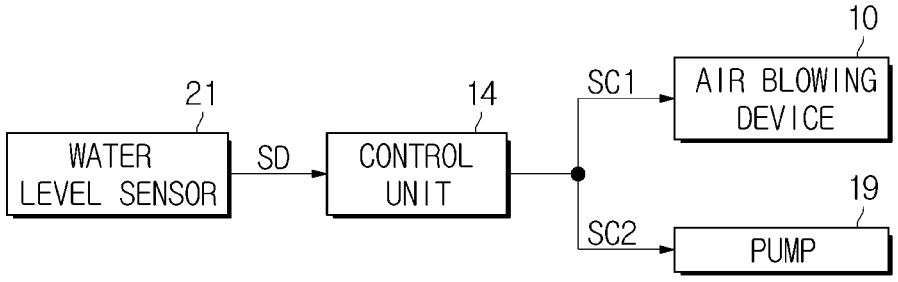
FIG. 9 is a control block diagram of the clothes dryer according to an exemplary embodiment.

As illustrated in FIG. 9, the clothes dryer D receives a detecting signal SD from the water level sensor 21, and has a control unit (i.e., a controller) 14 which generates a control signal SC1 based on the received detecting signal SD and controls the air blowing device 10. Also, the control unit 14 controls the air blowing device 10, generates a control signal SC2 based on the detecting signal SD received from the water level sensor 21, and then controls the pump 19.

—Operation of the Clothes Dryer—

Next, an operation of the clothes dryer D according to the exemplary embodiment will be described.

First, when the clothes dryer D is operated, the drum rotating motor, the air blowing device 10 and the heat pump cycle are operated. As the air blowing device 10 is operated, a negative pressure is generated at the upstream side (between the air blowing device 10 and the evaporator 9*b*) of the air blowing device 10, and a positive pressure is generated at a downstream side (between the air blowing device 10 and the circulation air intake port 32) of the air blowing device 10, and thus a pressure difference is generated. For example, a pressure at the upstream side of the air blowing device 10 may be lower than an atmospheric pressure by 300 Pa or more. The air in the drum 4 is circulated in the air circulation passage 8 according to such a pressure difference.

More specifically, as indicated by arrows A1 and A2 of FIG. 1, the drying air in the drum 4 is introduced into the exhaust side duct 5 through the circulation air exhaust port 31, flows toward a lower portion of a front side in the main body 1, and then is introduced into the drying duct 6.

As indicated by in an arrow A2 in FIG. 1, the air introduced into the drying duct 6 flows toward a rear portion of a lower side in the main body 1 along the drying duct 6. Because the condenser 9*a* and the evaporator 9*b* are sequentially disposed downstream in the drying duct 6, while passing through the drying duct 6, the drying air is first cooled and dehumidified by the condenser 9*a* and then heated by the evaporator 9*b*, and thus is in a proper state to dry the clothes C.

Because the drying duct 6 and the return side duct 7 face the air intake port 10*c* and air exhaust port 10*d* of the air blowing device 10, respectively, the drying air passed through the drying duct 6 as indicated by the arrows A2 and A3 in FIG. 1 is introduced into the return side duct 7 via the air blowing device 10. Also, as indicated by an arrow A3 in FIG. 1, the drying air introduced into the return side duct 7 flows toward an upper portion of a rear side in the main body 1, and then is introduced into the drum 4 through the circulation air intake port 32.

Therefore, while the clothes dryer D is operated, the air repeatedly performs the above-described circulation process, and maintains a predetermined humidity and temperature which is suitable for a drying operation, and thus the clothes C in the drum 4 may be dried. Also, while the clothes dryer D is operated, the drum 4 is rotated at a predetermined speed by an operation of the drum rotating motor (not shown), and thus the clothes C in the drum 4 may be agitated, and the drying air may be uniformly transferred to the clothes C in the drum 4.

Here, as the circulation process is repeated, the condensation water W is attached on a surface of the condenser 9*a* in the form of a water drop, and the attached condensation water W falls to the cover base 6*a* due to gravity. The condensation water W falling to the cover base 6*a* is guided to the drain hole 6*b* by the inclined cover base 6*a*, and then introduced to the base plate 11 through the drain hole 6*b*. The condensation water W introduced to the base plate 11 flows along the lower surface 11*a* of the base plate 11 to a right side of a rear portion thereof, and is transferred to the pump chamber 16 through the communication waterway 12 and accommodated in the pump chamber 16.

As the above-described circulation process is repeated, the water level of the condensation water W accommodated in the pump chamber 16, the communication waterway 12 and the base plate 11 is increased. When a condition in which the water level of the condensation water W in the pump chamber 16 reaches or exceeds a predetermined threshold value is detected by the water level sensor 21, the control unit 14 operates the pump 19. The condensation water W accommodated in the pump chamber 16 and the base plate 11 is transferred to the water storage tank 25 through the lift hose 20.

In the exemplary embodiment, because the lower end of the connection portion 12*b* which forms the internal upper surface of the communication waterway 12 is configured to be located at the position higher than the lower end of the drain hole 6*b* and the lower end of the V-shaped groove 6*c*, ventilation may be performed between the pump chamber 16 and the base plate 11, even when the water level of the condensation water W is increased. Therefore, the pressure difference between the pump chamber 16 and the base plate 11 may be reduced, and thus a difference in the water level of the condensation water W between the inside of the pump chamber 16 and an inside of the base plate 11 may be also reduced. Therefore, the pump 19 may be operated before the base plate 11 arrives at a full water level, and thus the back flow of the condensation water W may be prevented.

Also, even when atmospheric air is introduced from an outside through the leakage preventing hose 24 which is in communication with the base plate 26 for the water storage tank, some of the introduced air is introduced into the air circulation passage 8 through the first ventilation port 17, as indicated by an arrow A6 in FIG. 2, and thus a water surface of the condensation water W accommodated in the base plate 11 is not dispersed by the introduced air passing through the communication waterway 12.

Also, as indicated by an arrow A5, the remainder of the introduced air flows toward the V-shaped groove 6*c* of the cover base 6*a*, and then is introduced into the evaporator 9*b* through the ventilation holes 6*f* and 6*f* and rear sides of the cut-away portions 6*d* and 6*d* which are provided at the V-shaped groove 6*c*.

When the air volume is increased by increasing a rotational speed of the air blowing device 10 to enhance the drying performance, the condensation water W generated from the condenser 9*a* may overflow into the V-shaped groove 6*c* through the gaps 6*k* formed at the lateral directional ends of the rib 6*j* provided at the rear side of the condenser 9*a*. Even in this case, the condensation water W falls through front side ends and center side ends of the cut-away portions 6*d* and 6*d* (openings) or the drain hole 6*e*, and thus the condensation water W may be dispersed by the introduced air indicated by the arrow A5, and thus may be prevented from being introduced into the evaporator 9*b*.

As described above, the clothes dryer D according to the exemplary embodiment may prevent the back flow of the condensation water W, and, even when the air blowing device 10 having the high air volume is provided, the back flow or the scattering of the condensation water W may be reliably prevented. That is, the air blowing device 10 having the higher air volume may be provided in the clothes dryer.

Also, because the base plate 11 and the drying duct 6 are separated from each other by the cover base 6*a* which supports the condenser 9*a* and the evaporator 9*b*, the air is prevented from being introduced from a front side of the condenser 9*a* into the base plate 11, and thus an air flow (referring to an arrow A8 in FIG. 2) which flows to be introduced into the air blowing device 10 through the base plate 11 may be prevented.

Also, as indicated by an arrow A4 in FIG. 2, through the drain hole 6*b* installed in the cover base 6*a* and the cut-away portions 6*d* and 6*d* and the ventilation holes 6*f* and 6*f* provided at the V-shaped groove 6*c*, the drying air may pass through the drain hole 6*b* from the condenser 9*a*, may be introduced into the base plate 11, and then may be introduced from the base plate 11 into the evaporator 9*b* through the cut-away portions 6*d* and 6*d* and the ventilation holes 6*f* and 6*f*. The water drops condensed at the condenser 9*a* according to the flow of the drying air and falling to the cover base 6*a* are efficiently discharged to the base plate 11.

Also, even though the condensation water W overflows from the water storage tank 25 due to an unexpected situation, the overflowing condensation water W is collected at the base plate 26 for the water storage tank, and then is returned to the pump chamber 16 through the leakage preventing hose 24.

Figure 22:
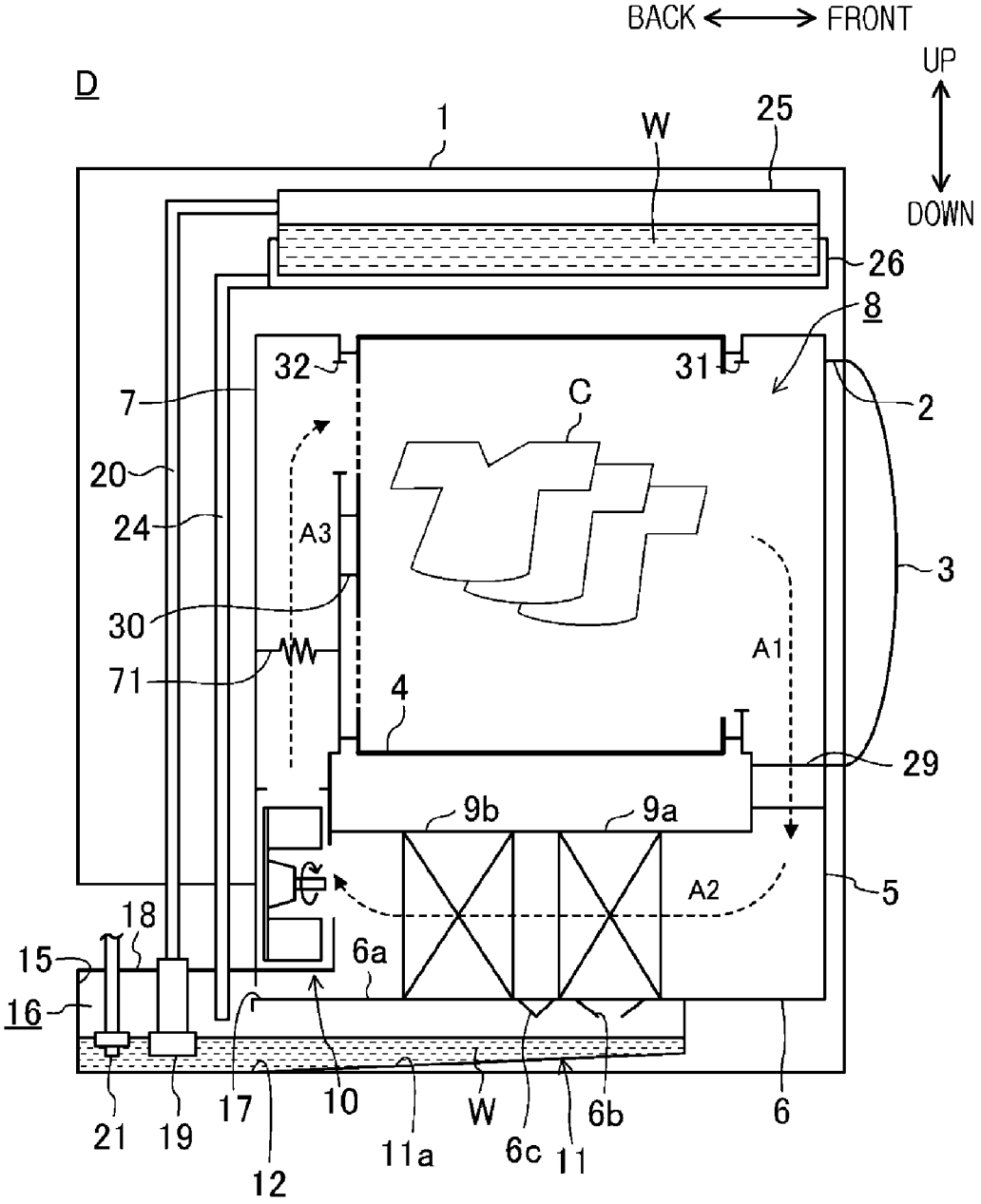
FIG. 22 is a view illustrating a modified exemplary embodiment of the clothes dryer corresponding to FIG. 1.

Further, in the exemplary embodiment, the cooling device and the heating device respectively consist of the condenser 9*a* and the evaporator 9*b* of the heat pump cycle. However, instead of the condenser 9*a*, other types of cooling device such as a water cooled device and an air cooled device may be used, and also, instead of the evaporator 9*b*, another type heating device such as a heater may be used. As illustrated in FIG. 22, a heater 71 may be additionally installed in the return side duct 7.

—Control of Pump and Air Blowing Device (1)—

Figure 10:
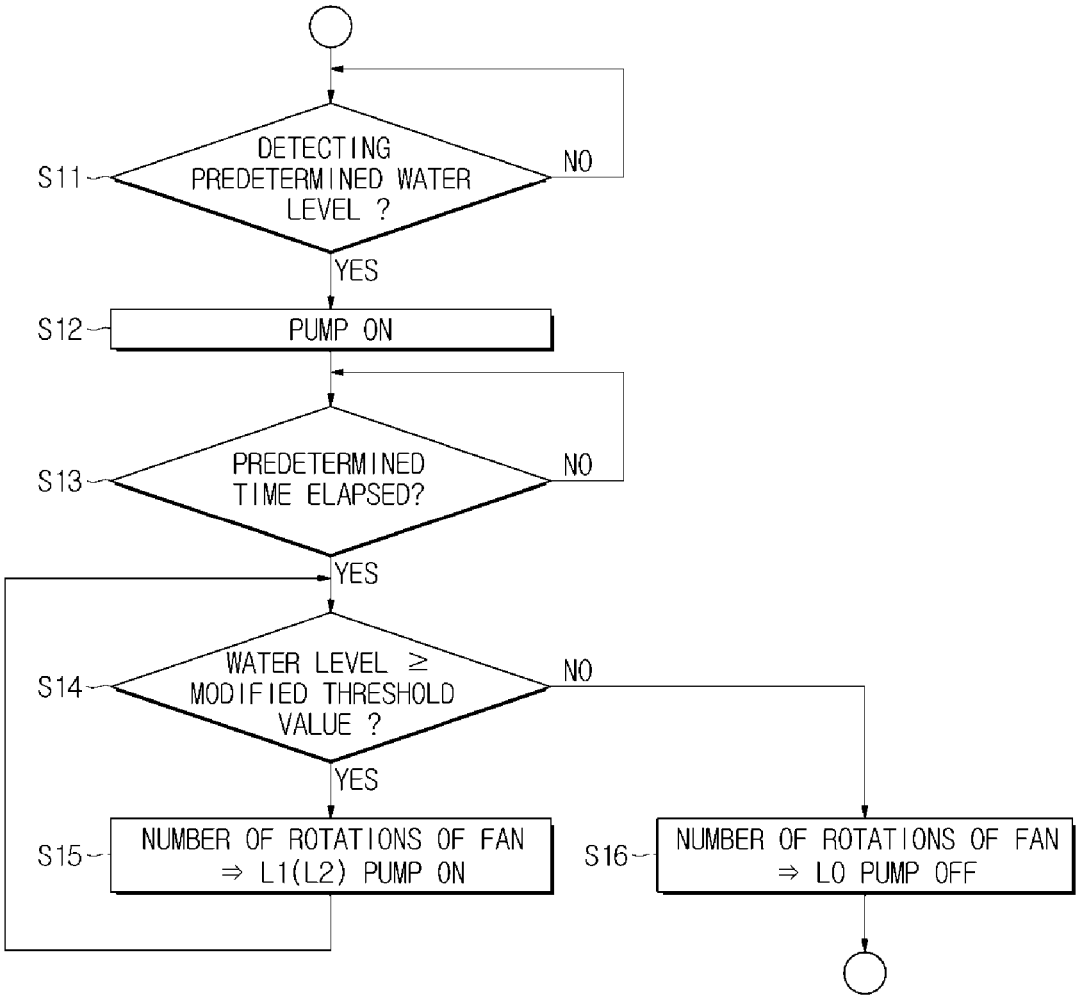
FIG. 10 is a control flow chart of the pump and the air blowing device according to an exemplary embodiment.

Next, an example of controlling the pump 19 and the air blowing device 10 using the control unit 14 will be described in detail with reference to a flowchart of FIG. 10.

In the exemplary embodiment, when an operation is started, the air blowing device 10 is rotated at a normal number of rotations L0 per a given time (e.g., per second or per minute). The normal number of rotations L0 of the air blowing device 10 and a low speed numbers of rotations L1 and L2 of the air blowing device 10 when the air blowing device 10 is rotated at a low speed are in a relationship of L0>L1>L2. When the operation is started, the pump 19 is in a stopped state, a "control of pump and air blowing device (2)", which will be described below, will be described in the same state. Also, the low speed number of rotations L1 satisfies the relationship of L0>L1>L2. As an example, the low speed number of rotations L1 may be 50% of the normal number L0 of rotations (a rated number of rotations).

First, when the above-described circulation process is continuously performed, the water level of the condensation water W accommodated in the pump chamber 16 and the base plate 11 is increased. If the water level sensor 21 detects a higher water level than the predetermined threshold value (YES in operation S11), the control unit 14 operates the pump 19 accommodated in the pump chamber 16 according to a detecting result (S12).

After a preset time of an operation of the pump 19 elapses, according to operation S12 (YES in operation S13), the control unit 14 checks whether the water level sensor 21 has detected a higher water level than the predetermined threshold value (S14). When the water level sensor 21 detects the higher water level than the predetermined threshold value (YES in operation S14), the control unit 14 determines that transferring of the condensation water W from the pump chamber 16 to the water storage tank 25 by the pump 19 is abnormal, and then reduces the number of rotations of the air blowing device 10 to L1 (S15).

The preset time may be discretionally set. However, when the pump 19 is operated normally, the preset time is set to a time which is sufficient for the water level detected by the water level sensor 21 to be less than the predetermined threshold value.

A determination that the transferring is abnormal refers to a case in which the pressure in the pump chamber 16 is lower than the atmospheric pressure, and the pressure difference between the pump chamber 16 and the atmospheric pressure is more than a predetermined value, and thus the transferring of the condensation water W by the pump 19 is not operated normally. Therefore, when the number of rotations of the air blowing device 10 is reduced as described above, the negative pressure at the upstream side of the air blowing device 10 may be temporarily reduced, and thus the pressure difference from the atmospheric pressure may be reduced. Therefore, the pump 19 which is not operated when the pressure difference is large as described above may be normally operated again.

In operation S15, when the number of rotations of the air blowing device 10 is reduced to L1, and the water level sensor 21 does not detect the higher water level than the predetermined threshold value (NO in operation S14), the control unit 14 returns the number of rotations of the air blowing device 10 to L0, and at the same time, stops the pump 19 (S16). Meanwhile, in operation S14, when the water level sensor 21 detects the higher water level than the predetermined threshold value, the clothes dryer D is controlled to maintain the air blowing device 10 in the number of rotations L1, or to further reduce the number of rotations of the air blowing device 10 to L2 (S15). And the operations S14 and S15 are repeated until the water level sensor 21 does not detect the higher water level than the predetermined threshold value.

Also, in operation S15, even though the number of rotations of the air blowing device 10 is reduced to L2, if the water level sensor 21 continuously detects the higher water level than the predetermined threshold value, the control unit 14 may control the number of rotations of the air blowing device 10 to be reduced lower than L2.

—Control of Pump and Air Blowing Device (2)—

Figure 11:
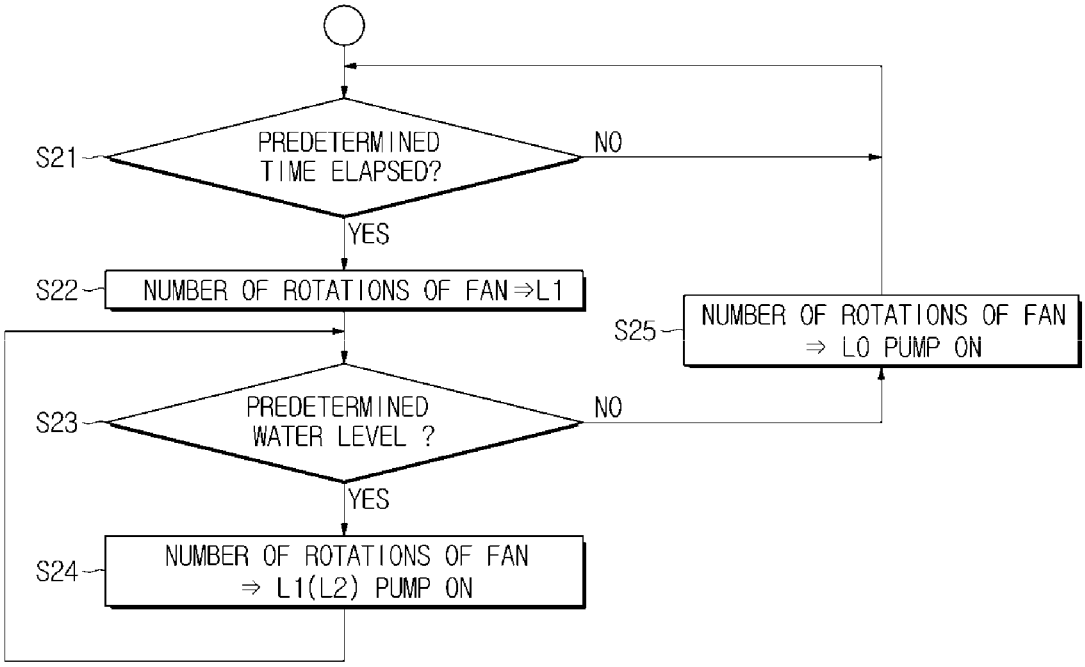
FIG. 11 is a control flow chart of the pump and the air blowing device according to an exemplary embodiment.
Figure 12:
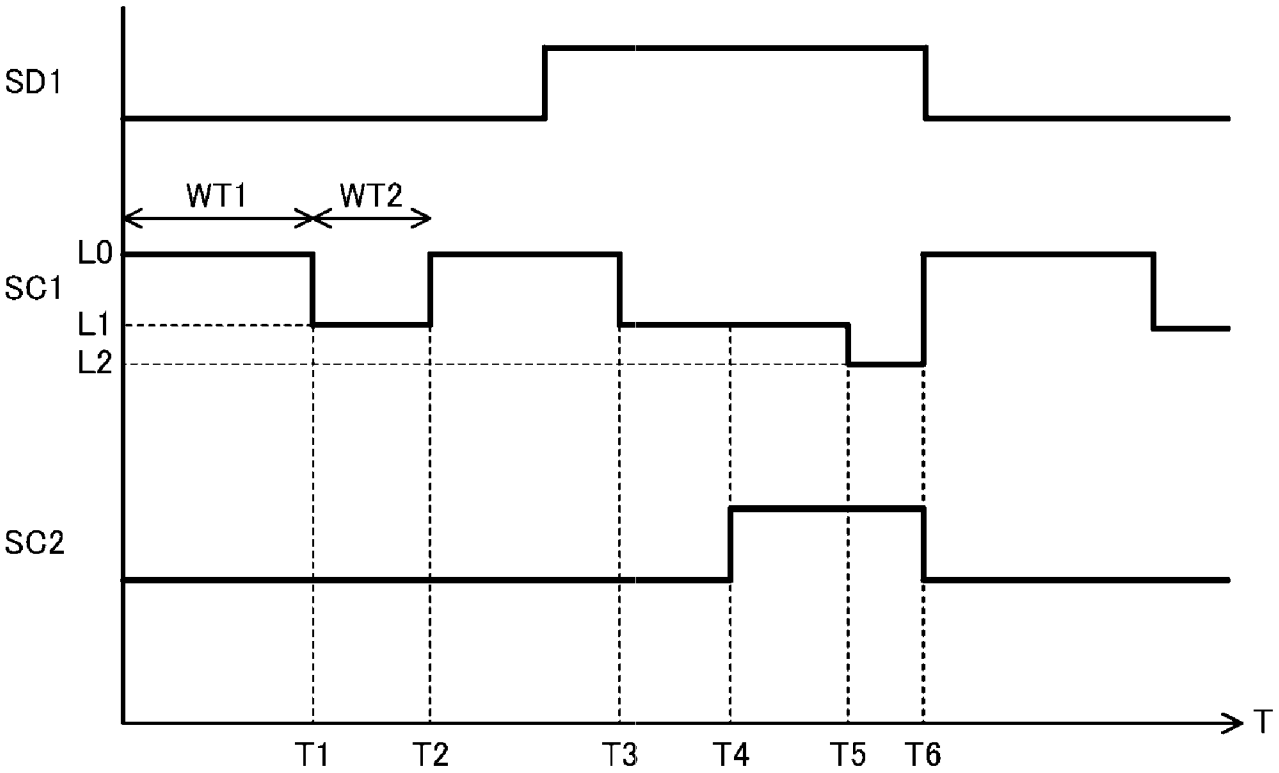
FIG. 12 is a timing chart illustrating a control example of the pump and the air blowing device according to an exemplary embodiment.

Next, another example of controlling the pump 19 and the air blowing device 10 will be described in detail with reference to a flowchart of FIG. 11 and a timing chart of FIG. 12. In the exemplary embodiment, the control unit 14 controls the number of rotations of the air blowing device to be reduced every preset time period (periodically). In the example of FIG. 12, a normal rotation time WT1 and a low speed rotation time WT2 are alternately repeated every preset time period. Also, the preset time period may be changed in a drying operation. For example, the preset time period may be set at early and late stages of the drying operation to be longer compared with a middle stage thereof.

That is, in the middle stage of the drying operation, the number of rotations of the air blowing device may be reduced in the shortest time period. Also, such a control of the preset time period is not limited thereto, and may be appropriately changed according to a dried state and a drying time of the clothes, or may be set in advance.

The control unit 14 reduces the number of rotations of the air blowing device 10 to L1 at a time T1 after the preset time WT1 has elapsed from a start of the drying operation (YES in operation S21) (S22). In operation S22, the number of rotations of the air blowing device 10 is reduced to L1, and then the control unit 14 checks at a time T2 whether the water level sensor 21 detects the higher water level than the predetermined threshold value (S23).

When the water level sensor 21 does not detect the higher water level than the predetermined threshold value (NO in operation S23), the control unit 14 returns the number of rotations of the air blowing device 10 to L0, and at the same time, maintains the pump 19 in the stopped state (S25). And the control unit 14 reduces the number of rotations of the air blowing device 10 to L1 (S22) at a time T3 after the preset time WT1 has elapsed (YES in operation S21).

Then, in operation S22, as illustrated in a time T4 of FIG. 12, when the water level sensor 21 detects the higher water level than the preset threshold value (YES in operation S23) after the number of rotations of the air blowing device 10 is reduced to L1 and the preset time WT2 has elapsed, the control unit 14 maintains the number of rotations of the air blowing device 10 at L1, turns on the pump 19 and starts the transferring of the condensation water W (S24).

In operation S24, when the water level sensor 21 continuously detects the higher water level than the preset threshold value (YES in operation S23) at a time T5 after the preset time (e.g., WT2) has elapsed (YES in operation S26), the control unit 14 controls the number of rotations of the air blowing device 10 to be reduced to L2, and maintains the pump 19 in an ON state (S24). And as illustrated in a time T6, when the water level sensor 21 does not detect the higher water level than the preset threshold value (NO in operation S23), the control unit 14 returns the pump 19 and the air blowing device 10 to the normal operation state.

Also, at the time T5, the control unit 14 may control the number of rotations of the air blowing device 10 to be maintained at L1. Also, in operation S24, even though the number of rotations of the air blowing device 10 is reduced to L2, when the water level sensor 21 continuously detects the higher water level than the predetermined threshold value, the control unit 14 may further reduce the number of rotations of the air blowing device 10 of the clothes dryer D to be lower than the low speed number of rotations L2.

As described above, in the exemplary embodiment, even when the pressure in the pump chamber 16 is lower than the atmospheric pressure, and the pressure difference is greater than the predetermined value, and the transferring of the condensation water W is not normally performed by the pump 19, the control unit 14 may reduce the number of rotations of the air blowing device 10 so that the pressure at the upstream side of the air blowing device 10 is temporarily increased, and thus the pump 19 may be normally operated. Because the pump 19 is normally operated, and the condensation water W may be transferred from the pump 19 to the water storage tank 25, the back flow of the condensation water W and the dispersing of the condensation water W in the air circulation passage 8 may be surely prevented. That is, even when air blowing performance of the air blowing device 10 is enhanced to increase the circulation air volume and thus to improve efficiency of the clothes dryer D, the condensation water W may be easily discharged from the pump chamber 16 by the pump 19. Also, even when the pressure in the air circulation passage 8 (each duct) and the pump chamber 16 is lower than a general state, the condensation water W may be easily discharged from the pump chamber 16 by the pump 19.

Also, the control of the pump 19 and the air blowing device 10 by the control unit 14 is not limited to the "controls of pump and air blowing device (1) and (2)". For example, instead of the number of rotations of the air blowing device 10 being reduced step by step, the number of rotations of the air blowing device 10 may be gradually reduced by the detecting result of the water level sensor 21, and at the same time, the number of rotations of the air blowing device 10 may be set to be maintained at a number of rotations in which a reduction of the water level is detected.

While one exemplary embodiment has been described so far, the inventive concept is not limited thereto, and may be remodeled and modified variously, as disclosed in the following exemplary embodiments. Also, the above-described embodiment and the following exemplary embodiments may be appropriately combined with each other.

Second Exemplary Embodiment

Figure 13:
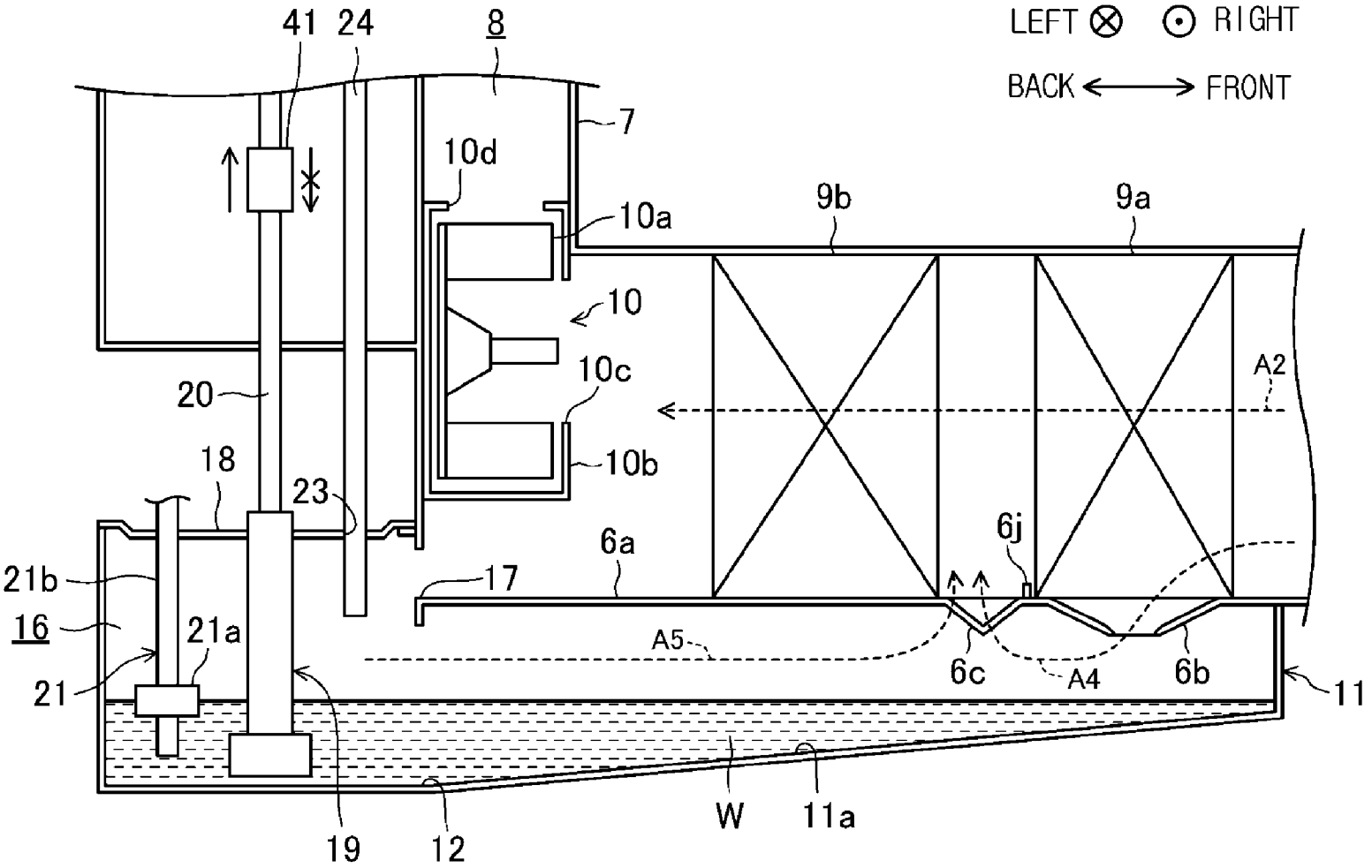
FIG. 13 is a view illustrating a modified exemplary embodiment of the clothes dryer corresponding to FIG. 2.

FIG. 13 is a view illustrating a clothes dryer D according to a second exemplary embodiment. The clothes dryer D of FIG. 13 is different from that of FIG. 2 in that a check valve 41 which prevents the air from being introduced from the water storage tank 25 toward the pump 19 is disposed at the lift hose 20 connecting the pump 19 with the water storage tank 25. Due to the check valve 41, the air in the pump casing 19*b* may be prevented from being introduced from the water storage tank 25 through the discharge port 19*f* of the pump 19, and also from being collected around the impeller 19*e* and forming bubbles. That is, the condensation water W may be normally discharged by the pump 19.

Third Exemplary Embodiment

Figure 14:
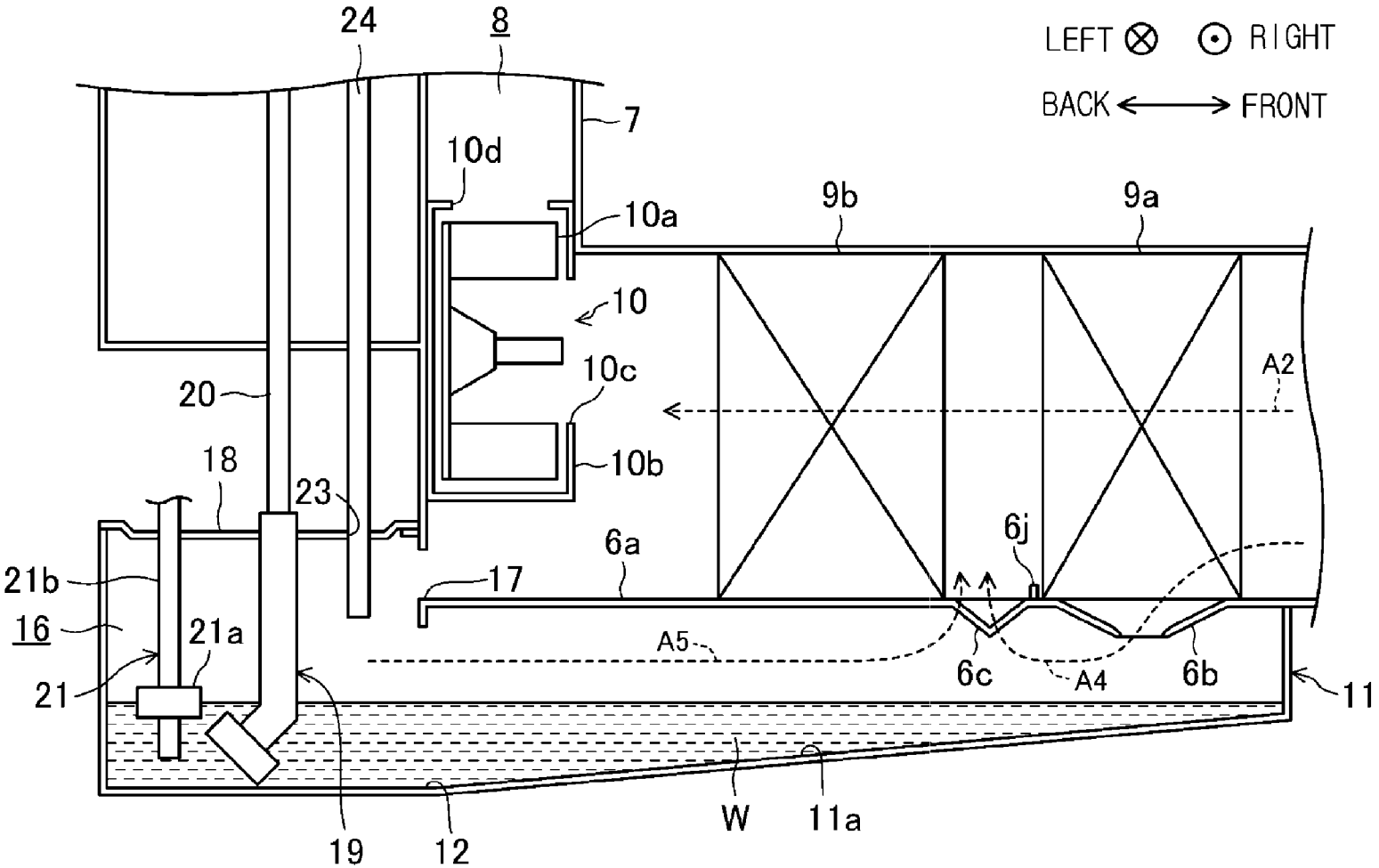
FIG. 14 is a view illustrating a modified exemplary embodiment of the clothes dryer corresponding to FIG. 2.

FIG. 14 is a view illustrating a clothes dryer D according to a third exemplary embodiment. The clothes dryer D of FIG. 14 is different from that of FIG. 2 in that the impeller 19*e* and the suction port 19*a* of the pump casing 19*b* are disposed to be inclined with respect to a horizontal plane. Specifically, as illustrated in FIG. 15, the motor 19*d*, the shaft 19*c* and the impeller 19*e* of the pump 19, a part of the pump casing 19*b* accommodating them, and the suction port 19*a* are disposed to be inclined with respect to the horizontal plane, such that the discharge port 19*f* is disposed higher.

Figure 15:
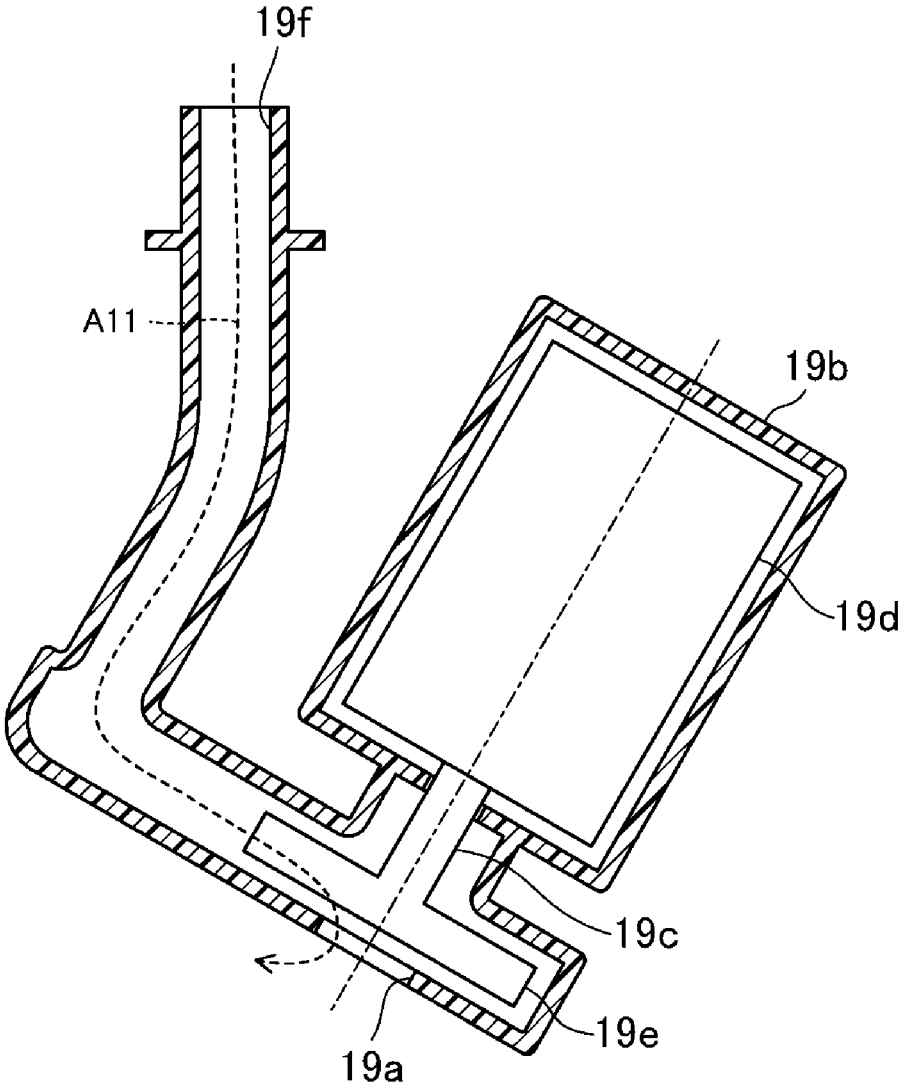
FIG. 15 a view illustrating a schematic structure of a pump as a modified exemplary embodiment of FIG. 10 corresponding to FIGS. 6 and 7.

Due to such a structure, even when the air is introduced (flows back) from the water storage tank 25 into the pump casing 19*b* through the discharge port 19*f*, the air is discharged from an upper end side of the suction port 19*a* which is inclined as indicated by an arrow A11 in FIG. 15, and thus the air is not collected around the impeller 19*e*, and the impeller 19*e* may be submerged. That is, the bubbles may be prevented from being generated in the pump 19, and the condensation water W may be normally discharged by the pump 19. Also, the impeller 19*e* and the suction port 19*a* of the pump casing 19*b* may be inclined vertically (perpendicularly) to the horizontal plane.

Figure 23:
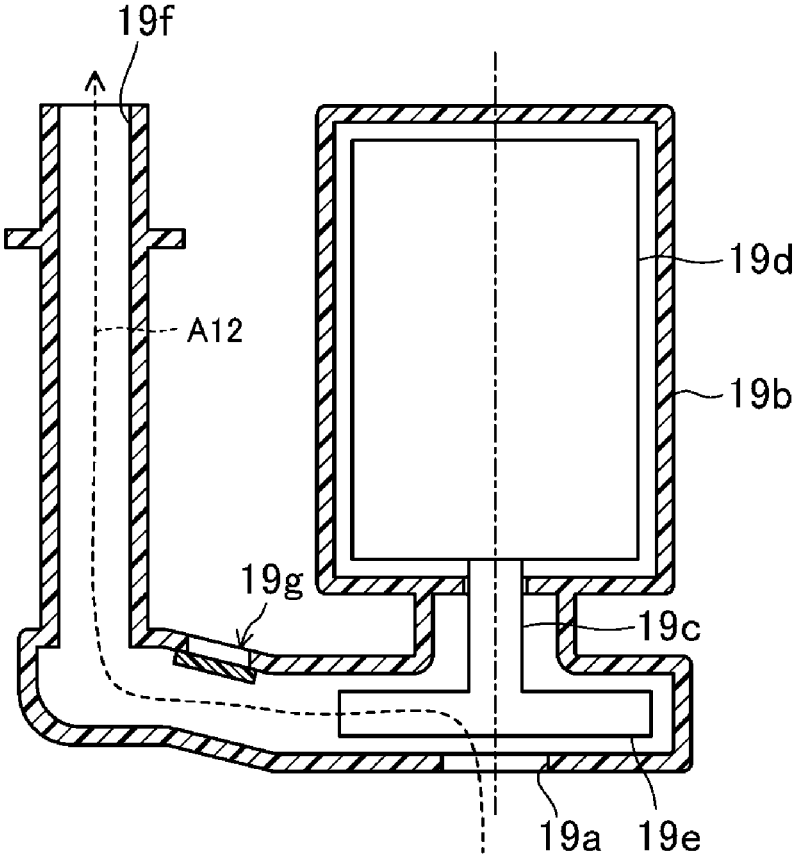
FIGS. 23 and 24 are views illustrating a schematic structure of a pump as modified exemplary embodiments of FIGS. 7 and 8.
Figure 24:
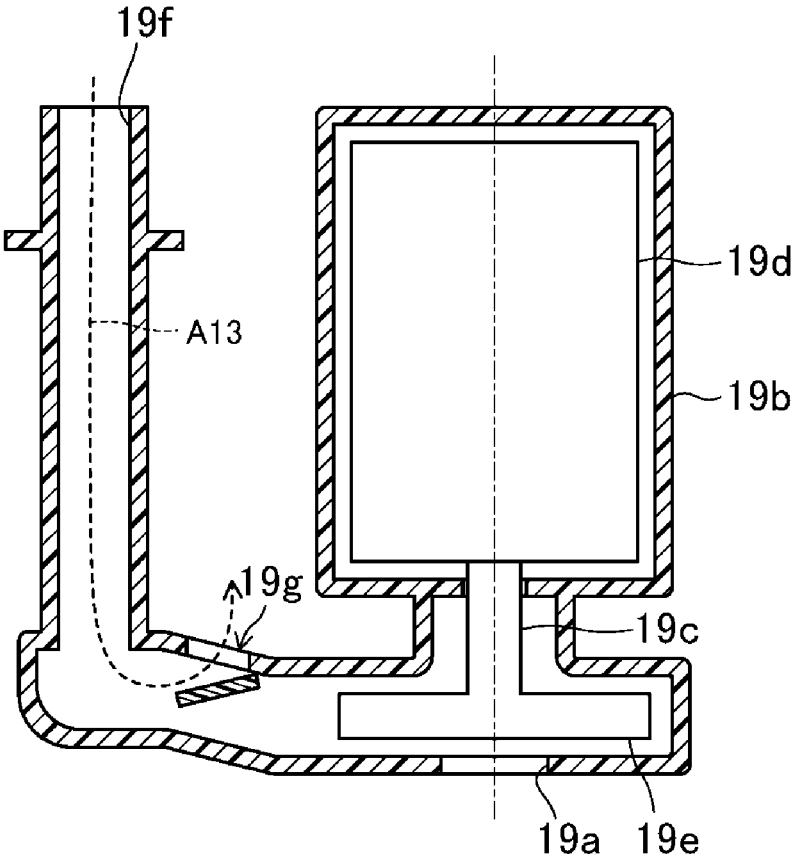

Also, as illustrated in FIGS. 23 and 24, a valve 19*g* which discharges the air introduced through the discharge port 19*f* of the pump casing 19*b* may be installed at an internal upper portion of the pump casing 19*b* between the discharge port

19*f* and the impeller 19*e*. More specifically, the valve 19*g* is configured to be closed by a water flow when the impeller 19*e* is rotated (referring to an arrow A12 in FIG. 23), and to be opened when the air is introduced, such that the introduced air is discharged to an outside of the pump casing 19*b* (referring to an arrow A13 of FIG. 24). Therefore, the air may not be collected around the impeller, and thus the bubbles may be prevented from being generated.

Fourth Exemplary Embodiment

Figure 16:
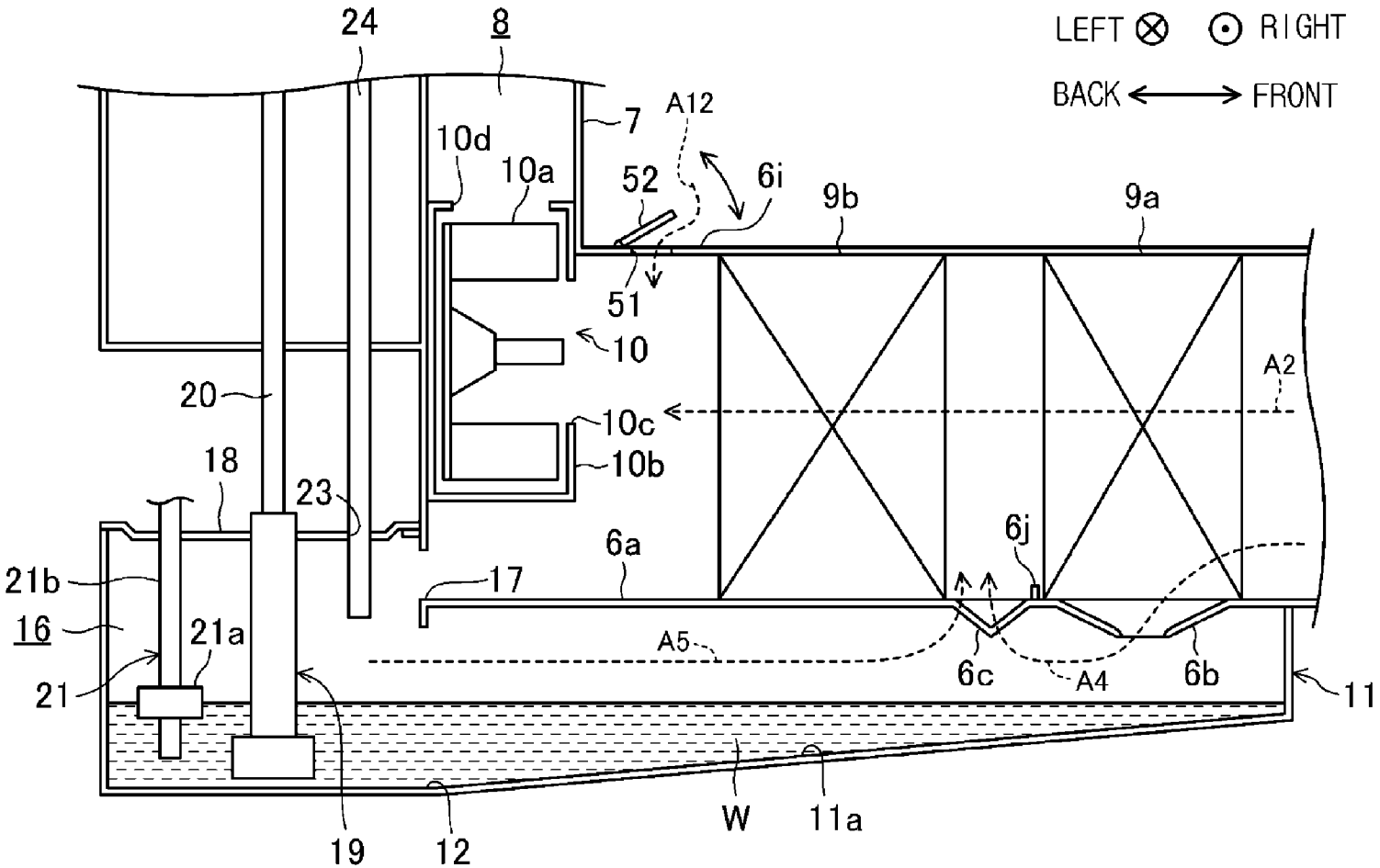
FIGS. 16 to 20 are views illustrating a modified exemplary embodiment of the clothes dryer corresponding to FIG. 2.

FIG. 16 is a view illustrating a clothes dryer D according to a fourth exemplary embodiment. The clothes dryer D of FIG. 16 is different from that of FIG. 2 in that a third ventilation hole 51 passing through an upper plate 6*i* of the drying duct 6 in the vertical direction is installed between the evaporator 9*b* and the air blowing device 10 so that the air circulation passage 8 is in communication with an internal space of the clothes dryer D. Also, the clothes dryer D according to the exemplary embodiment includes an opening and closing valve 52 which opens and closes the third ventilation hole 51 depending on certain conditions. The opening and closing valve 52 may be controlled by the control unit 14.

Depending on the certain conditions, the opening and closing valve 52 closes the third ventilation hole 51, for example, at an early stage of the drying operation (in which the condensation water is hardly generated), and opens the third ventilation hole 51, when the condensation water is collected. Alternatively, the opening and closing valve 52 may be controlled to open the third ventilation hole 51 only when the control unit 14 operates the pump 19 according to the detecting result of the water level sensor 21.

As described above, because the third ventilation hole 51 is provided at the drying duct 6, the pressure at the upstream side of the air blowing device 10 is lower than the atmospheric pressure, and the pressure difference is increased, and the negative pressure is generated at the pump chamber 16, and thus the condensation water W may be normally discharged by the pump 19. Further, because the opening and closing valve 52 is provided, the air volume introduced from the third ventilation hole 51 may be controlled, and thus the pressure difference between the pressure at the upstream side of the air blowing device 10 and the atmospheric pressure may be maintained at an optimal value. Furthermore, the opening and closing valve 52 may not be absolutely necessary, and the condensation water W may be normally discharged by the pump 19 without the opening and closing valve 52.

Fifth Exemplary Embodiment

Figure 17:
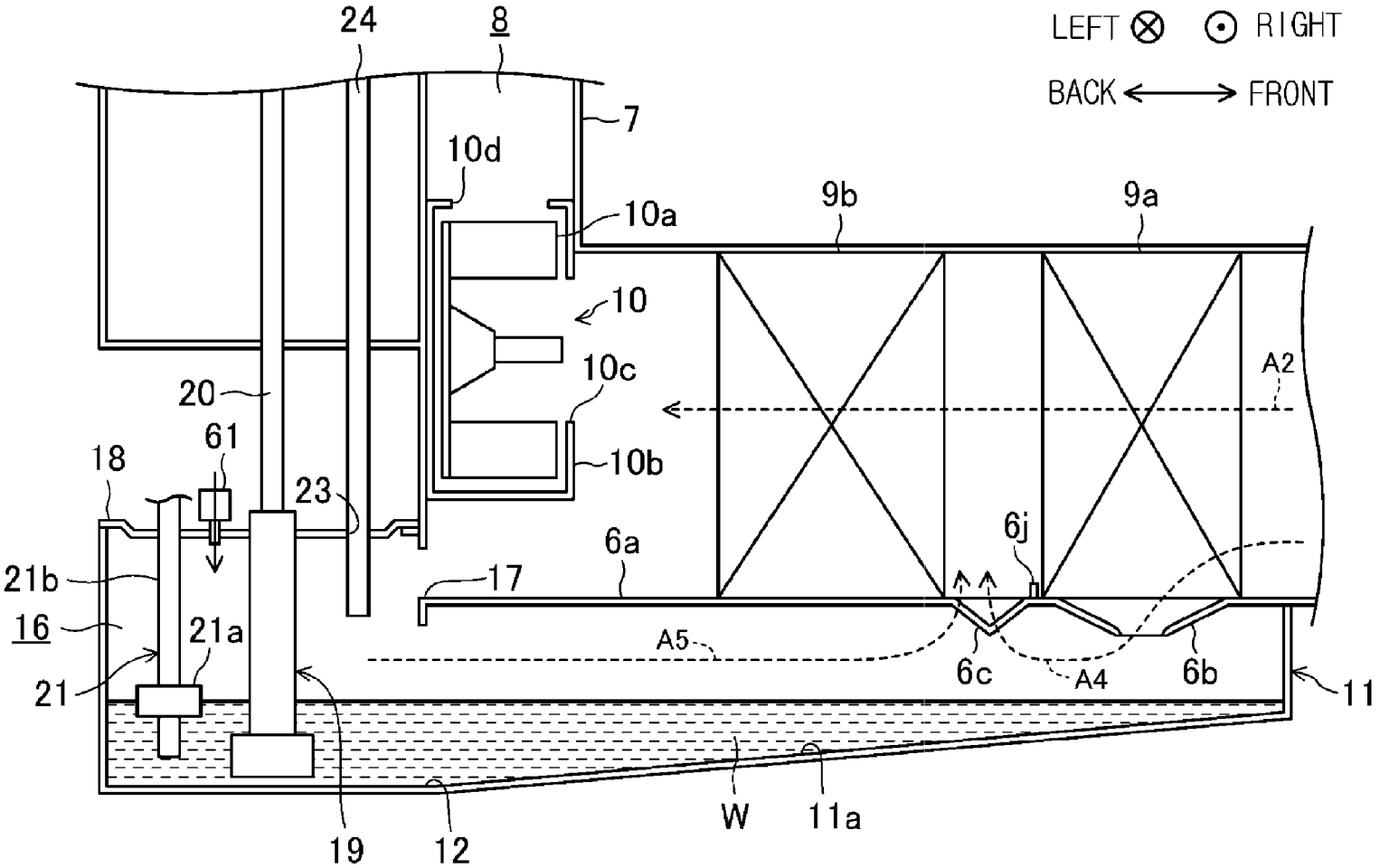

FIG. 17 is a view illustrating a clothes dryer D according to a fifth exemplary embodiment. The clothes dryer D of FIG. 17 is different from that of FIG. 2 in that a check valve 61 is installed in the cover 18 of the pump chamber 16.

The pump chamber 16 is connected to an atmospheric air side through the check valve 61, and when the pressure in the pump chamber 16 is lower than the atmospheric pressure, and thus the pressure difference between them is greater than the predetermined value (e.g., 300 Pa or more), the check valve is opened so that the atmospheric air is introduced. Therefore, the negative pressure may be constantly maintained in the pump chamber 16, and the air may be prevented from being introduced from the water storage tank 25 into the pump chamber 16 through the discharge port 19*f* of the pump 19, and thus the condensation water W may be normally discharged by the pump 19.

Sixth Exemplary Embodiment

Figure 18:
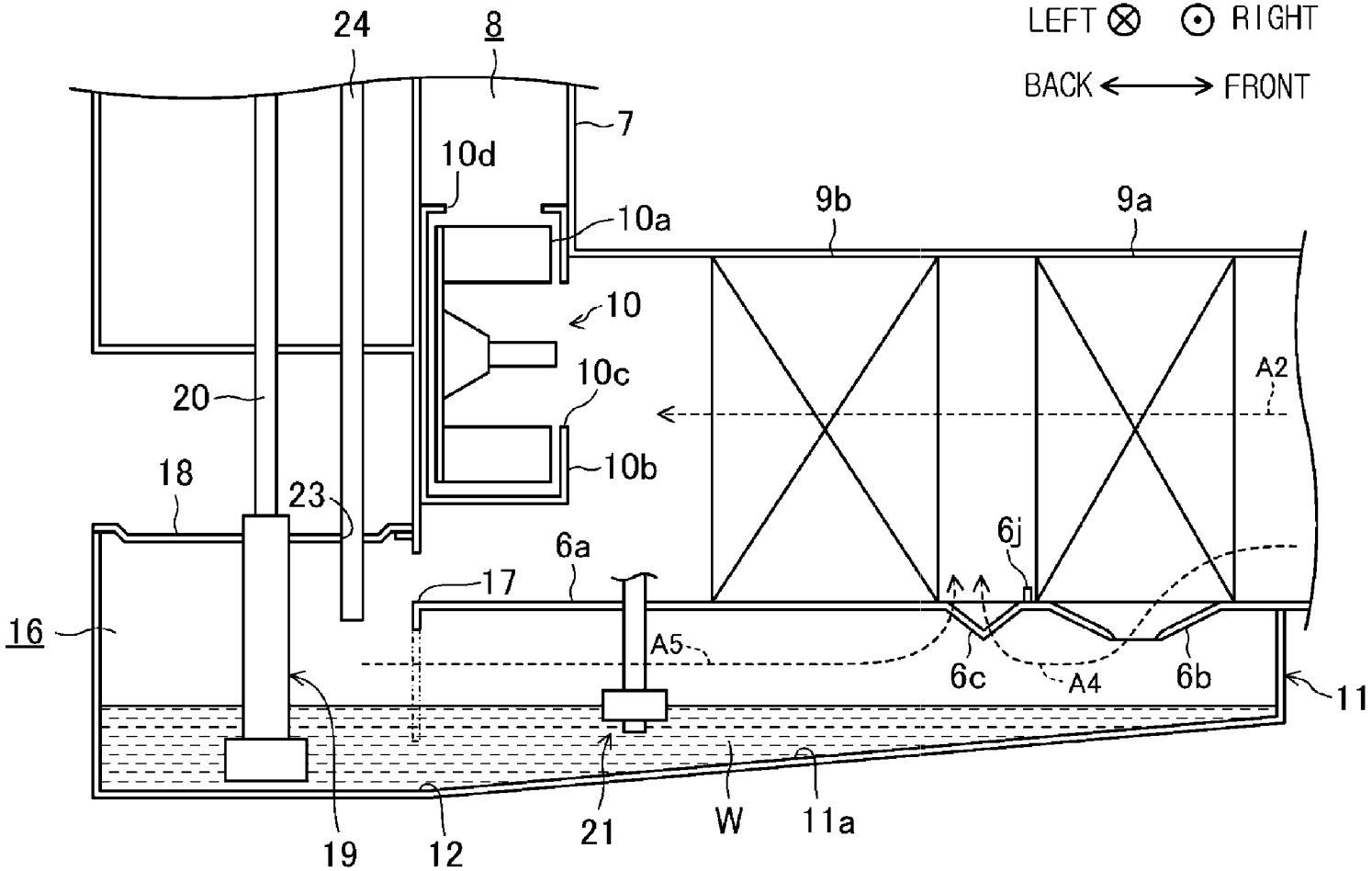

FIG. 18 is a view illustrating a clothes dryer D according to a sixth exemplary embodiment. The clothes dryer D of FIG. 18 is different from that of FIG. 2 in that the water level sensor 21 is installed in the base plate 11, instead of the pump chamber 16.

Due to such a structure, it may be directly measured whether the water level of the condensation water W in the base plate 11 will be dispersed or will flow back into the air circulation passage 8. That is, when a lower portion of the base plate 11 is in communication with a lower portion of the pump chamber 16 through the communication waterway 12 (referring to an imaginary line of FIG. 18), it is further useful, because the water level in the base plate 11 is different from that in the pump chamber 16. Also, the water level sensor 21 may be installed in the pump chamber 16 and the base plate 11, respectively.

Seventh Exemplary Embodiment

Figure 19:
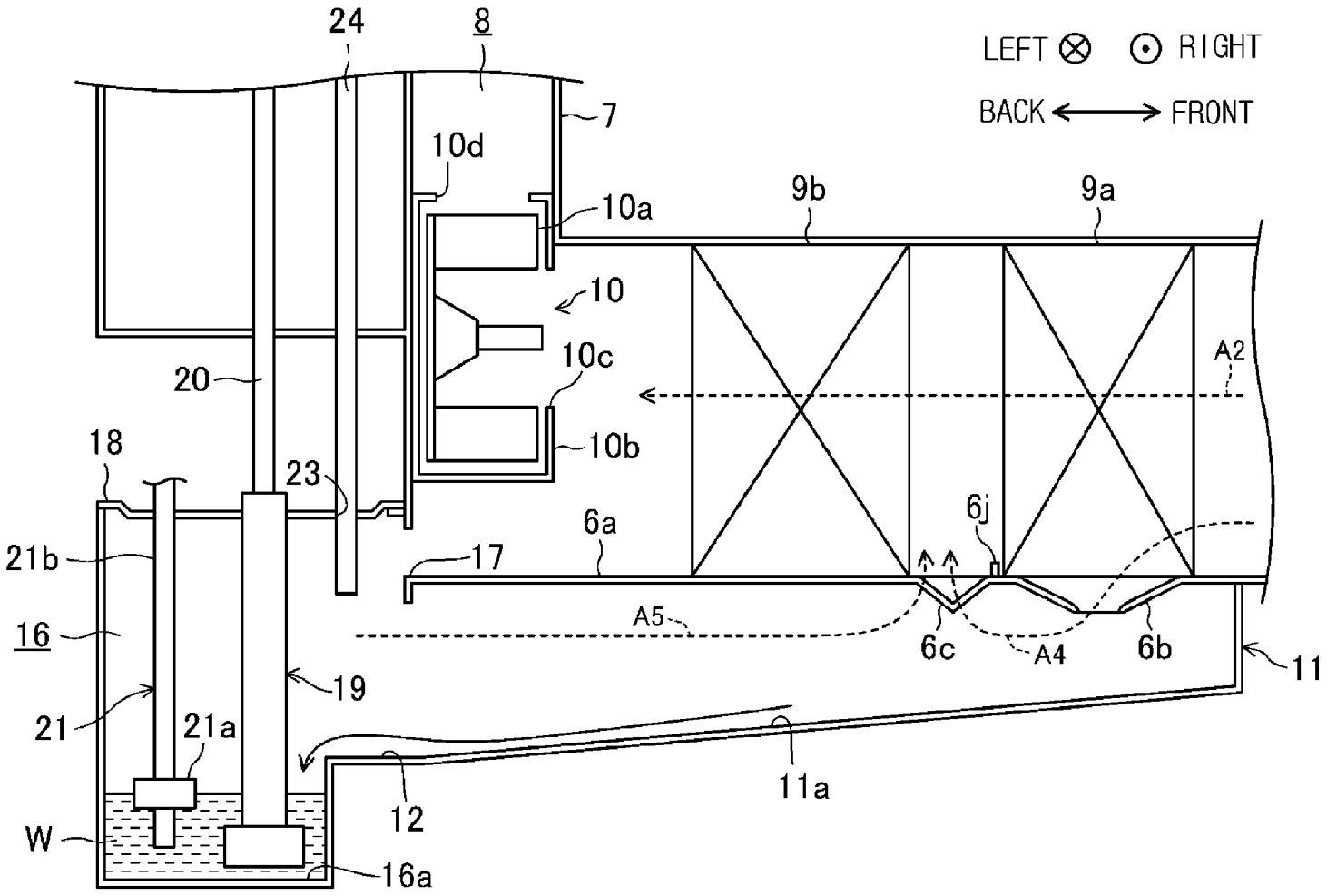

FIG. 19 is a view illustrating a clothes dryer D according to a seventh exemplary embodiment. The clothes dryer D of FIG. 19 is different from that of FIG. 2 in that a lower surface 16*a* of the pump chamber 16 is provided to be located at a lower position than a lower end of the communication waterway 12, and the preset threshold value (for determining whether the pump 19 is operated) for the detected water level of the water level sensor 21 disposed in the pump chamber 16 is set to be located at a lower position than the lower end of the communication waterway 12.

Due to such a structure, a difference in the water surface of the condensation water W between before and after the condensation water W is introduced into the pump chamber 16 occurs, and the condensation water W introduced into the pump chamber 16 may be prevented from flowing back by influence of a pressure difference. That is, the backflow of the condensation water W may be prevented.

Eighth Exemplary Embodiment

Figure 20:
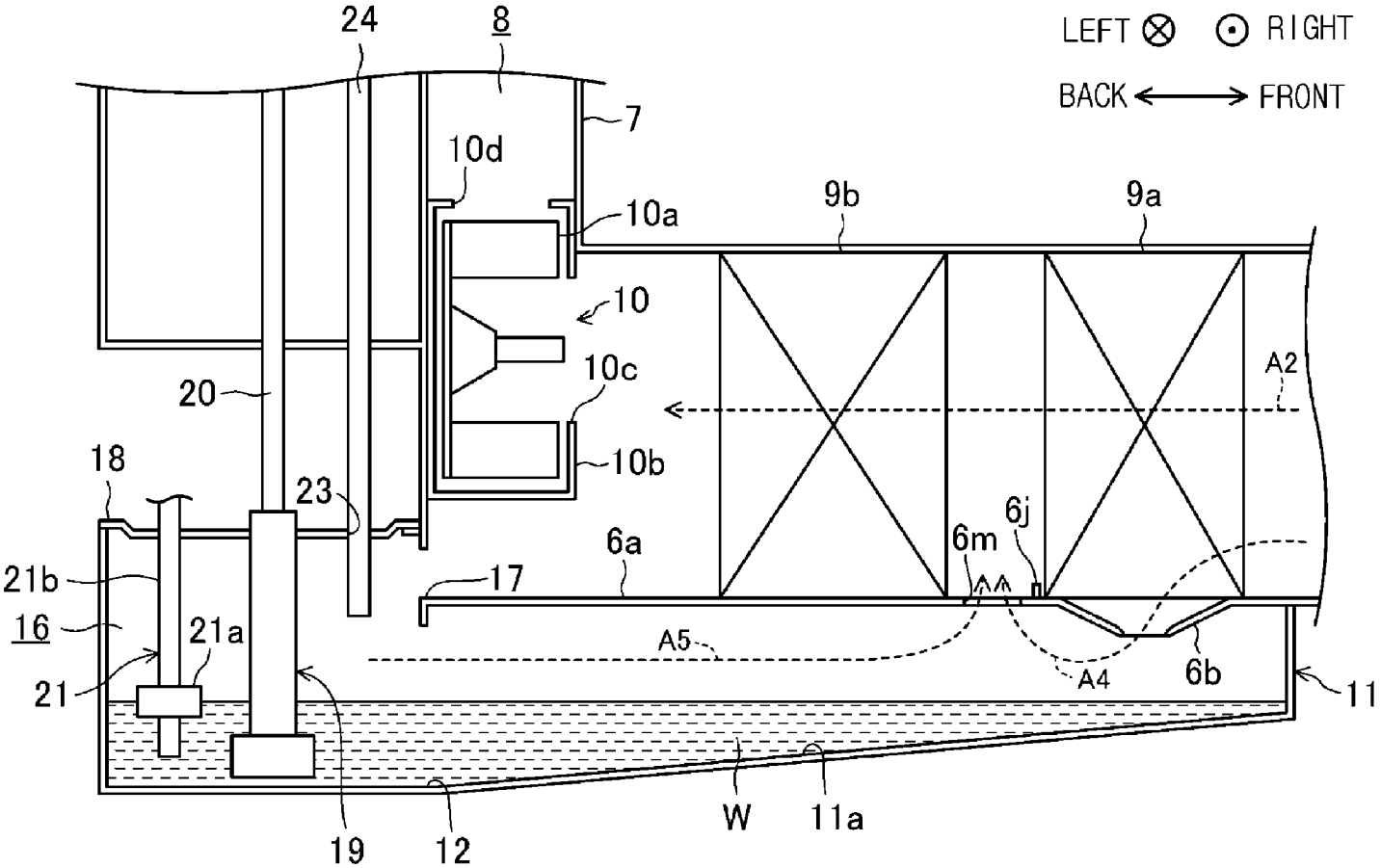
Figure 21:
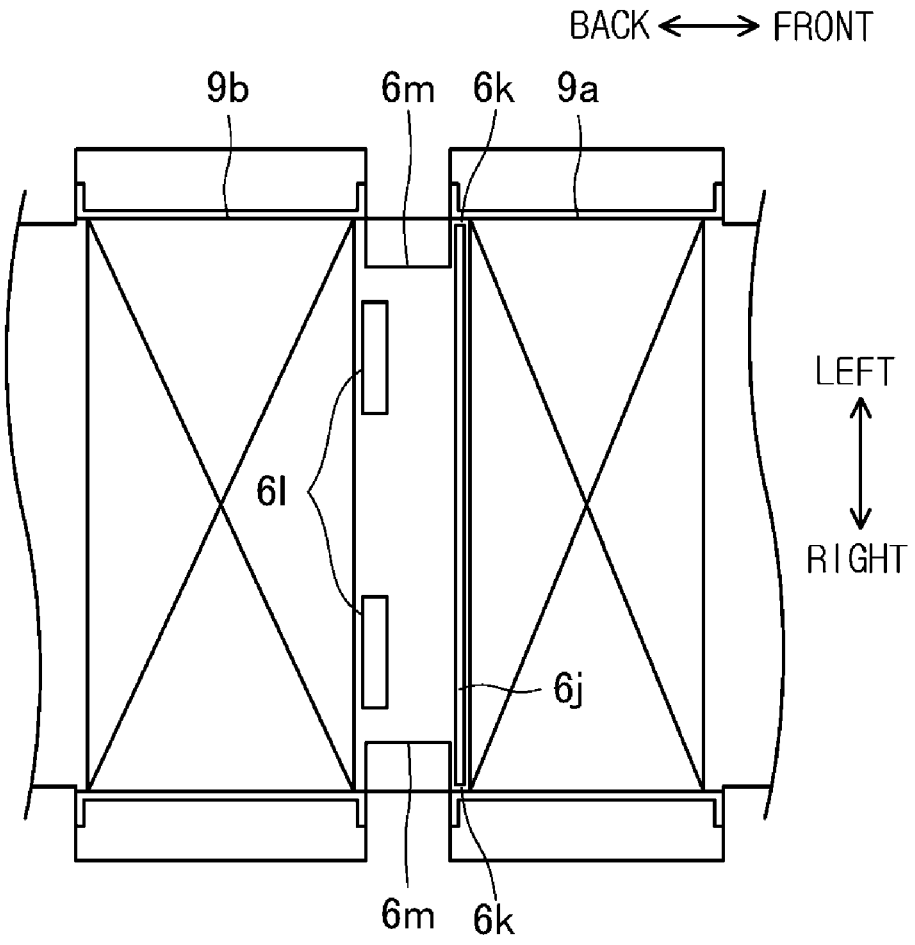
FIG. 21 is an enlarged view illustrating the vicinity of the ventilation hole of the cover base as a modified exemplary embodiment of FIG. 16.

FIGS. 20 and 21 are views illustrating a clothes dryer D according to an eighth embodiment.

The clothes dryer D of FIG. 20 is different from that of FIG. 2 in that the V-shaped groove 6*c* is not provided in the cover base 6*a*, and there is a flattened connection between the condenser 9*a* and the evaporator 9*b*. Also, as illustrated in FIG. 21, there is another difference in that, instead of the cut-away portions 6*d* and 6*d* provided at both lateral directional ends of the cover base 6*a*, cut-away portions 6*m* and 6*m* cut in the form of rectangular shapes toward a center side and serving as ventilation holes are formed between the condenser 9*a* and the evaporator 9*b*. Also, there is still another difference in that ventilation holes 6*l* are formed instead of the ventilation holes 6*f* and 6*f*. Further, a shape of the ventilation hole 6*l* is not limited to the rectangular shape which extends in the lateral direction. Specifically, the ventilation hole 6*l* may be installed between the condenser 9*a* and the evaporator 9*b* or may be formed in an elliptical shape which extends in the lateral direction, or a plurality of circular or elliptical holes may be disposed in the lateral direction.

Due to such a structure, even when some of the condensation water W generated at the condenser 9*a* overflows through the gaps 6*k* formed at the lateral directional ends of the rib 6*j* provided at the rear side of the condenser 9*a*, the condensation water W may be discharged to the base plate 11 through the cut-away portions 6*m* and 6*m*. Therefore, in the same manner as that described in the above-described exemplary embodiment, the condensation water W flowing out through the gap 6*k* may be prevented from being dispersed due to the introduced air indicated by the arrow A5 in FIG. 20 and thus prevented from being introduced into the evaporator 9*b*.

In the clothes dryer according to the exemplary embodiments as described above, the support plate which supports the cooling device and the heating device is a partition between the air circulation passage and the base plate, and the communication waterway connects between the base plate and the pump chamber, and the first ventilation hole by which the air circulation passage is in communication with the pump chamber and the second ventilation hole by which the air circulation passage is in communication with the base plate are provided, and thus the pump can be operated before the water flows back into the air circulation passage, and the backflow of the condensation water can be surely prevented.

Although exemplary embodiments have been particularly shown and described above, it would be appreciated by those skilled in the art that various changes may be made therein without departing from the principles and spirit of the inventive concept, the scope of which is defined in the following claims.

What is claimed is:

1. A clothes dryer comprising:

a drum configured to accommodate clothes;

an air circulation passage connected to the drum;

a cooling device configured to cool and dehumidify air in the air circulation passage;

a heating device configured to heat air passing through the cooling device;

an air blowing device configured to circulate air along the air circulation passage;

a base plate configured to collect condensation water generated from the cooling device;

a pump chamber configured to accommodate a pump configured to transfer the condensation water;

a water circulation passage connecting the base plate to communicate with the pump chamber and configured to guide the condensation water from the base plate to the pump chamber;

a communication passage provided between the air circulation passage and the base plate and configured to guide the condensation water generated at the cooling device to the base plate;

a first ventilation hole provided between the heating device and the air blowing device and configured to provide a first air passage between the air circulation passage and the pump chamber; and a second ventilation hole provided between the cooling device and the heating device and configured to provide a second air passage between the air circulation passage and the base plate.

2. The clothes dryer according to claim 1, further comprising a support plate configured to partition the air circulation passage and the base plate from each other and to support the cooling device and the heating device, wherein the first ventilation hole and the second ventilation hole are provided at the support plate.

3. The clothes dryer according to claim 2, wherein the support plate comprises a concave portion provided between the cooling device and the heating device and recessed downward, and wherein the second ventilation hole is provided at the concave portion so that ventilation between the air circulation passage and the base plate is performed.

4. The clothes dryer according to claim 3, wherein the concave portion is formed by a V-shaped groove which extends in a widthwise direction of the clothes dryer and in an intersecting direction to a flowing direction of the air passing through the cooling device in the air circulation passage, and wherein the V-shaped groove comprises a cut-away portion having a width thereof gradually narrowing toward a center side in a lengthwise direction perpendicular to the widthwise direction of the V-shaped groove is provided at opposite ends of the V-shaped groove along the widthwise direction of the clothes dryer.

5. The clothes dryer according to claim 1, further comprising a water level detecting part configured to detect a water level in the pump chamber, and a controller configured to control the air blowing device, wherein the controller is configured to control the air blowing device to reduce a number of rotations in a given time, in response to a preset time elapsing after an operation of the pump is started and water level detected by the water level detecting part being greater than or equal to a preset threshold value.

6. The clothes dryer according to claim 1, further comprising a water storage part configured to receive the condensation water transferred by the pump, wherein the pump is connected to the water storage part through a connection waterway, and a check valve configured to prevent air from being introduced from the water storage part toward the pump is installed at a connection waterway.

7. The clothes dryer according to claim 1, further comprising a water storage part configured to receive the condensation water transferred by the pump, wherein the pump comprises:

a pump casing having:

a suction port configured to intake the condensation water; and a discharge port configured to discharge the condensation water to the water storage part, a motor disposed in the pump casing and comprising:

an output shaft extending in a direction perpendicular to a surface of the suction port, and an impeller configured to rotate along with the output shaft, and wherein the suction port and the impeller of the pump casing are inclined with respect to a horizontal surface so that the discharge port is located higher.

8. The clothes dryer according to claim 1, wherein a third ventilation hole is provided between the heating device and the air blowing device and is configured to provide a third air passage between the air circulation passage and a space excluding the air circulation passage, the base plate and the pump chamber.

9. The clothes dryer according to claim 8, further comprising an opening and closing valve configured to open or close the third ventilation hole according to a preset condition.

10. The clothes dryer according to claim 1, wherein the pump chamber is connected with an atmospheric air through a check valve, and wherein in response to a pressure in the pump chamber being lower than an atmospheric pressure by a predetermined value or more, the check valve is configured to be opened so that atmospheric air is introduced into the pump chamber.

11. The clothes dryer according to claim 1, further comprising a water level detecting part configured to detect a water level in the pump chamber, and a controller configured to control the air blowing device and the pump, wherein the controller is configured to control a fan of the air blowing device to be alternatively rotated at a first number of rotations in a given time and a second number of rotations in the given time which is lower than the first number of rotations according to a preset time period, and to control the pump to operate, in response to the water level detected by the water level detecting part being greater than or equal to a preset threshold value while the fan is rotated at the second number of rotations in the given time.

12. The clothes dryer according to claim 1, further comprising a water level detecting part configured to detect a water level in the base plate, and a controller configured to control the air blowing device, wherein the controller is configured to control a number of rotations of the air blowing device in a given time to be reduced in response to a preset time elapsing after an operation of the pump is started and the water level detected by the water level detecting part being greater than or equal to a preset threshold value.

13. The clothes dryer according to claim 1, further comprising a water level detecting part configured to detect a water level in the base plate, and a controller configured to control the air blowing device and the pump, wherein the controller is configured to control a fan of the air blowing device to be alternatively rotated at a first number of rotations in a given time and a second number of rotations in the given time which is lower than the first number of rotations according to a preset time period, and to control the pump to operate, in response to the water level detected by the water level detecting part being great than or equal to a preset threshold value while the fan is rotated at the second number of rotations in the given time.

14. The clothes dryer according to claim 5, wherein a lower surface of the pump chamber is located at a position lower than a lower end of the water circulation passage, and wherein the preset threshold value of the detected water level is set to be lower than a lower end of the water circulation passage.

15. The clothes dryer according to claim 4, wherein an internal upper surface of the water circulation passage is located at a position higher than the communication passage and a lower end of the V-shape groove with respect to a gravitational direction.

16. A method of controlling a clothes dryer, comprising:

rotating a fan of an air blowing device at a first number of rotations in a given time and comparing a water level detected by a water level detecting part and a preset threshold value;

operating a pump in response to the detected water level being greater than or equal to the preset threshold value;

determining whether a preset time elapses after the pump is operated;

detecting the water level by the water level detecting part in response to the preset time elapsing, and comparing the detected water level and the preset threshold value; and rotating the fan at a second number of rotations in the given time which is lower than the first number of rotations in the given time in response to the detected water level being greater than or equal to the preset threshold value.

17. The method according to claim 16, wherein, in response to the detected water level being less than the preset threshold value after the preset time elapsing, controlling the fan to return to the first number of rotations in a given time, and stopping the pump.

18. A method of controlling a clothes dryer, comprising:

rotating a fan of an air blowing device at a first number of rotations in a given time;

determining whether a preset time elapses;

rotating the fan at a second number of rotations in the given time which is lower than the first number of rotations in the given time, in response to the preset time elapsing;

comparing a water level detected by a water level detecting part and a preset threshold value; and in response to the water level being greater than or equal to the preset threshold value, maintaining the fan to rotate at the second number of rotations in the given time, or controlling the fan to rotate at a third number of rotations in the given time which is lower than the second number of rotations in the given time, and controlling a pump to operate.

19. The method according to claim 18 further comprising repeatedly determining whether the water level is greater than or equal to the preset threshold value while the fan is controlled to rotate at the second number of rotations, or is controlled to rotate at the third number of rotations.

20. The method according to claim 18, wherein, in response to the detected water level being less than the preset threshold value, controlling the fan to returned to rotating at the first number of rotations in the given time, and stopping the pump.

* * * * *